US007980858B2

(12) United States Patent
Valoe et al.

(10) Patent No.: US 7,980,858 B2
(45) Date of Patent: Jul. 19, 2011

(54) LEARNING ENVIRONMENT

(75) Inventors: Elise Valoe, Grand Rapids, MI (US); Julie Barnhart, Grand Rapids, MI (US); Heather Barton, Grand Rapids, MI (US); Jennifer Alexandra Curtis, Great Falls, VA (US)

(73) Assignee: Steelcase Development Corporation, Grand Rapids, MI (US)

( * ) Notice: Subject to any disclaimer, the term of this patent is extended or adjusted under 35 U.S.C. 154(b) by 1054 days.

(21) Appl. No.: 11/771,004

(22) Filed: Jun. 29, 2007

(65) Prior Publication Data

US 2009/0000228 A1 Jan. 1, 2009

(51) Int. Cl.
*A47B 39/00* (2006.01)

(52) U.S. Cl. ..... 434/432

(58) Field of Classification Search ..... 434/237, 434/365, 431, 432, 433; 52/36.1, 747.1; D6/396, 397

See application file for complete search history.

(56) References Cited

U.S. PATENT DOCUMENTS

| | | | | | |
|---|---|---|---|---|---|
| 44,082 | A * | 9/1864 | Eastman | 434/431 |
| 2,858,579 | A * | 11/1958 | Koelb | 52/234 |
| 3,107,577 | A | 10/1963 | Adams | |
| 3,366,415 | A * | 1/1968 | Cooper | 297/158.3 |
| 3,378,963 | A * | 4/1968 | Obata | 52/34 |
| 3,464,018 | A | 8/1969 | Cliff | |
| 3,487,595 | A | 1/1970 | Schumann | |
| 3,514,817 | A | 6/1970 | Sahm | |
| 3,659,355 | A | 5/1972 | Aubin, Jr. | |
| 3,727,328 | A * | 4/1973 | Valenzuela | 434/432 |
| 3,778,911 | A * | 12/1973 | Woolman | 434/432 |
| 3,818,609 | A * | 6/1974 | Woolman | 434/237 |
| 4,962,420 | A | 10/1990 | Judenich | |
| 5,448,287 | A | 9/1995 | Hull | |
| 5,567,164 | A * | 10/1996 | Durkin et al. | 434/432 |
| 5,673,145 | A | 9/1997 | Wilson | |
| 5,957,698 | A * | 9/1999 | Dean et al. | 434/350 |
| 5,964,064 | A | 10/1999 | Goddard et al. | |
| 6,253,494 | B1 | 7/2001 | Shaffron | |
| 6,293,052 | B1 | 9/2001 | Varnado, Jr. | |
| 6,401,469 | B1 * | 6/2002 | Dennis et al. | 62/175 |

(Continued)

OTHER PUBLICATIONS

Teal Classroom; http://ceci.mit.edu/projects/3d_visualization/teal_classroom.html; printed Jun. 1, 2007; 2 pages.

(Continued)

*Primary Examiner* — Kurt Fernstrom
(74) *Attorney, Agent, or Firm* — Quarles & Brady LLP

(57) ABSTRACT

A learning environment having a plurality of tables and a plurality of technology display devices distributed about the environment for use by occupants of the learning environment, the environment including a central area, the learning environment comprising at least first, second and third technology display devices that include first, second and third substantially flat display surfaces, respectively, for displaying information to occupants in the environment, the first, second and third displays supported in spaced radial relationship about the environment with the flat display surfaces substantially facing the central area, and at least first, second and third elongated tables that have first, second and third elongation axis, respectively, the tables arranged in spaced radial orientations around the environment with the elongation axis substantially extending toward the central area and so that open spaces are formed between adjacent tables for standing occupants, wherein the second and third elongation axis form angles with the second and third display surfaces in the range between seventy-five and ninety degrees.

79 Claims, 16 Drawing Sheets

U.S. PATENT DOCUMENTS

| | | | | |
|---|---|---|---|---|
| 6,407,798 | B2 | 6/2002 | Graves et al. | |
| D472,397 | S * | 4/2003 | Wineberg et al. | D6/396 |
| 6,650,396 | B2 | 11/2003 | Li | |
| 6,681,985 | B1 | 1/2004 | Curtin et al. | |

OTHER PUBLICATIONS

Brehm; teal room, technology enabled active learning; MIT News Office; Dec. 12, 2001 Tech Talk; http://web.mit.edu/evolving; 1 page.
Long; Educause Review, Learning Space Design in Action; Jul./Aug. 2005, vol. 40, No. 4; http://www.educause.edu/apps/er/erm05/erm0546.asp?bhcp=1, 3 pages.
Miller; Paradigm Shift, How Higher Education is Improving Learning; 2006 Herman Miller Inc.; 7 pages.
MARTEC Technobrief; Mid-Atlantic Regional Technology in Education Consortium; Temple University, Philadelphia PA; http://www.temple.edu/MARTEC/publications/technobriefs/tbrief29-b.html; printed Jun. 1, 2007; 2 pages.
CCIT-Clemson Computing & Information Technology; Skip Navigatioin; Faculty Directions, Fall 2005; The Use of the SCALE-UP Teaching Approach in the First Year of Engineering; http://ccit.clemson.edu/resources/articles/scaleup_engineering.php; printed Jun. 1, 2007; 2 pages.

* cited by examiner

LEARNING ENVIRONMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to conference or classroom configurations and more specifically to a room layout that supports a limited number of people and that, due to arrangement of furniture and teaching tools, fosters interaction and cooperative learning as well as small group discussions.

Traditional classrooms have been designed to focus attention on one person, a teacher or instructor, typically located at the front of the classroom. Here, the idea has been to configure classrooms based on the premise that instructors teach and students learn and, while there may be some communication between instructors and individual students during teaching sessions (e.g., questions and answers, etc.), small group discussions were to occur outside the normal teaching session hours and communications from students during a teaching session were to flow through the instructor to other students.

To concentrate student attention on an instructor, instructor focused classrooms are typically equipped with a large blackboard or whiteboard along a front wall of a classroom space with large numbers of student chair/desk combinations or chair/table combinations arranged in rows and columns throughout the remainder of the space to orient students to face the instructor's presentation board. In some cases interactive whiteboards and/or projectors and/or flat screen monitors are used instead of a black board or a whiteboard to enhance instructor presentations. In some cases chair/table combinations include tables or table and chair combinations that are permanently secured in place within the classroom. Permanently secured tables/chairs ensure an orderly appearance and also reduce the amount of noise from moving furniture during class sessions. In other cases tables and chairs are free standing and can be moved around within a classroom to be rearranged.

In at least some cases it has been recognized that in a classroom, in addition to a primary instructor, many students bring experiences, tools, knowledge and other resources to the classroom that can be shared with others to enhance the learning experience. Additional student experiences are particularly prevalent at the college level and above where many students have unique practical work and/or life experiences that relate to classroom topics that all students and instructors can benefit from.

In addition to work and life experiences that students obtain over time, technology has rendered vast amounts of information extremely and readily accessible enabling students to quickly develop useful theories and concepts that are relevant to classroom topics and that are independent of instructor direction. For instance, the Internet enables students to access and study information on almost any topic which can be electronically saved for subsequent classroom presentation. Moreover, classroom data links enable students to access information via the Internet or other networks in real time so that information relevant to classroom topics can be presented to a class by any student at any time during a session.

It has also been recognized that, for at least some subjects, instructor focused classrooms are not always optimal and that the learning and information/concept sharing processes can be enhanced through small group activities. In this regard, some subjects (e.g., lab experiments, preparation for a small group presentation, open discussion of controversial issues, etc.) are simply better handled in small groups. In addition, it is generally accepted that students have different comfort levels when it comes to public speaking and that some students are more comfortable speaking in relatively small groups. Here, some students prefer to test their ideas/theories in small groups prior to presenting to a larger group. Thus, by breaking up into small groups during at least some class sessions or portions of sessions, more information and concepts are shared and student participation is increased appreciably.

Recognizing the value of small group activities and student sharing/discussion, many instructors now encourage and even expect student discussion during teaching sessions and build small group activities into teaching sessions. Here, large group activities are supposed to feel more like informal discussions among equals instead of one way instructor-to-student lectures while small group activities are used to allow all students to get more involved and feel more involved in classroom activities and to share their ideas and theories in the comfortable and relatively less threatening environment of a small group.

Unfortunately, traditional instructor focused classroom layouts impede large group discussions and often impede small group discussions as well for several reasons. First, traditional classrooms usually arrange students so that students are looking at the backs of other students. Here, for a first student to converse with a second student sitting in a row of desks behind the first student, the first student has to either turn around and face the second student or has to raise her voice to a level sufficient for the second student to hear. In some cases teachers at the front of a classroom are forced to repeat comments and questions that students make during class for others in the class to hear. Repeating comments/questions breaks up discussion flow and can result in inadvertent rephrasing of student comments/questions which changes the meanings of the comments/questions from the original intent. In addition, talking loudly is unnatural and uncomfortable for some students and therefore can inhibit full discussion of topics.

Moreover, discussions are often more meaningful and complete when people face each other and look at each other during the discussions. By facing each other during a discussion, students can use body language and facial expressions to gauge whether or not other students are understanding comments being made and can judge how other students are responding to comments made. Where students all face in one direction, if a first student does not turn around to face others when speaking or when being spoken to, communications are less effective.

Second, often student discussion is interleaved with presentation of information by an instructor or by another student via a presentation board (e.g., whiteboard, interactive whiteboard, projector screen or display, etc.) at the front of the classroom and student comments/questions relate to the information presented by the teacher even when the comments or questions are directed toward another student. In many cases, when a student is referring to front board information, the student needs to generally face the information being referenced in order to formulate the comment or question. Thus, in a traditional instructor focused classroom, even when a first student is addressing a second student sitting behind the first student, the first student has to face forward and away from the second student to formulate and make a comment even when the first student would prefer to face the second student when making the comment. Similarly, in order for a first student to follow a comment or question about presented information made by a second student, the first student often has to face the information presented via the board in order to make sense of the comment/question despite wanting to generally face the first student as the comment is made.

Third, in cases where tables or tables and chairs are permanently secured to a floor within a classroom, those tables and chairs cannot be readily rearranged to facilitate small group activities. Even where desks and chairs are freestanding and therefore could be rearranged to facilitate small group activities, often the desks and chairs are not rearranged and instead adjacent students are asked to turn to each other during small group sessions to avoid the distraction of rearranging the desks and chairs. Here, the students do not have a common work surface and are often turned away from each other when memorializing information via a computing device, pen and paper, etc. In cases where desks and chairs are rearranged, the rearranging process is often very distracting and requires valuable class session time to both rearrange and then, at the end of class, to rearrange again into the instructor focused configuration. Moreover, even where desks are rearranged to facilitate group activities, often, while the students may face each other, the desk top surfaces may not abut nicely and therefore the combined desktops may include physical barriers (e.g., gaps between at least portions of adjacent tops) that impede sharing (e.g., movement of paper, devices, etc.) among the students in a small group.

Fourth, even in cases where student desks and chairs can be reconfigured to facilitate small group activities, most teacher focused classrooms do not provide a separate large format presentation board (e.g., whiteboard, blackboard, interactive whiteboard, etc.) for each of the small groups within a classroom. Here, it has been recognized that it is particularly helpful in small groups to have a common large format presentation board of some type for developing group ideas where all members of the small group can see information as it is developed and can comment and make suggestions during the information development process.

One effort to design a classroom that facilitates teacher focused lectures as well as small group lab activities is described in an article titled "Learning Space Design in Action" by Phillip D. Long that appeared in the July/August 2005 edition of Educase Review (hereinafter "the Long article"). The Long article describes a 3,000 square foot TEAL (Technology Enabled Active Learning) classroom that includes thirteen seven foot diameter round tables, 117 chairs, 40 laptop computers, eight projectors and associated display screens, whiteboards, a plurality of cameras and a single lectern. The display screens and whiteboards are mounted to or proximate all four of the room walls that define the classroom space and the projectors are mounted to a room ceiling and directed toward the display screens for projecting images thereon. The cameras are focused on separate portions of the whiteboards to be used by different subgroups of students.

The thirteen tables are arranged in three rows where each row includes three to five tables each. Groups of nine chairs are arranged around each of the thirteen tables. Three laptop computers are provided on each of the tables, a separate laptop to be used by sub-groups of three students at each of the tables (i.e., there are three sub-groups of three students each at each of the tables) to facilitate small group activities. The lectern is located centrally within the classroom space and a teacher's laptop is provided on the lectern.

In use, when a primary teacher lectures, the primary teacher is at the lectern centrally located in the classroom space and students can turn toward the teacher to follow along. The teacher can present information via the projector screens for students to view and the students can turn toward the projector screen closest to their location to view presented information. During small group activities, the sub-groups of three students at each table huddle together around their common laptop or at the space associated with their common laptop and perform group activities. If desired, students adjacent wall mounted whiteboards can use the adjacent whiteboards to facilitate group activities. Students at tables that are not proximate whiteboards mounted to walls can get up and move as groups to an unused whiteboard surface and use that surface to facilitate small group activities. When information is presented via one of the whiteboards, an associated camera can be used to take a picture thereof and the picture can be presented via the projectors to all students in the classroom space.

While the TEAL classroom has features that facilitate lectures as well as small group lab type activities, unfortunately, even the TEAL classroom has several shortcomings. First, because the TEAL classroom was designed for large lectures and small group discussions, not surprisingly, the room has several characteristics that impede large group discussions involving all of the students in the room. To this end, while a primary instructor standing relatively centrally within the TEAL room may be observable by students throughout the TEAL room, the shear size of, and number of students to be accommodated by the TEAL room makes it difficult at best for students on opposite sides of the room to see each other, much less to effectively communicate with each other. For instance, in some cases a first student at a first table on one side of the TEAL room has to look past students at three intermediate tables in order to see a second student at a second table on the opposite side of the room. Communication over three seven foot diameter intermediate tables, each of which accommodates nine students, is a challenge.

Second, where students are referring to common projected information, the students in the TEAL room tend to face the closest projected images. Facing a closest projected image often causes students to look away from other students being addressed. For instance, where a first student at a table proximate one corner of a TEAL room is talking to a second student at a table located at a distant corner of the room and is referring to commonly projected information, each of the first and second students naturally turns away from the other and views the closest projected information which makes communication difficult at best. Exacerbating this tendency to look away from the student being addressed, the large dimensions of the room (e.g., 60 or more feet) make it difficult to clearly see projected images when looking across the room. Difficulty in seeing projected images across the TEAL room is not surprising as the TEAL room was not designed for large group discussions and instead was designed for instructor focused lectures and small group activities where students do not have to communicate across the entire TEAL room space.

Third, while the TEAL classroom chairs rotate, the amount of rotation required for students to directly face all other students during a large group discussion is excessive and can be distracting. For instance, for many of the chairs in the TEAL classroom, students using the chairs would have to rotate through a full 360° in order to face each of the other students within the classroom at different times during a session. While some rotation is acceptable, excessive rotation can be an annoyance to both the student that has to constantly rotate to face other students and other students around the rotating student.

Fourth, while the edges of seven foot round tables may be suitable for three student small group activities, these relatively large tables are not optimal for relatively larger (e.g., 6-8 person) group activities. For example, where nine students are gathered around a seven foot diameter table so that students on opposite sides of the table are separated by at least seven feet, the volume at which students need to speak in order to communicate across the table is greater than the volume that would normally be acceptable in most small group activities where multiple small groups share a single classroom space. Where students have to raise their voices to share ideas, at least some students will remain silent.

Fifth, while most of the tables in the TEAL classroom are proximate whiteboards that can be used by students at the tables, at least a subset of the tables in the TEAL classroom are not proximate a whiteboard and therefore students at this subset of tables have to move from their tables to a distant whiteboard in order to use a common presentation space. It is believed that the inconvenience associated with having an entire small group of students leave a table to use a whiteboard will greatly reduce the extent to which the whiteboards are used for collaborative activities.

Thus, a need exists for a versatile classroom configuration that can facilitate instructor focused lectures, large group discussions and small group activities where students in the classroom can face and have an essentially direct line of sight to any other student in the classroom at any time as well as simultaneously having a direct line of sight to commonly presented information in a large display format. It would also be advantageous if the configuration that achieves the above results were relatively inexpensive.

BRIEF SUMMARY OF THE INVENTION

It has been recognized that a small number of tables and common presentation boards (e.g., whiteboards, chalkboards, electronic interactive whiteboards, projector screens, etc.) can be radially arranged in a classroom space or learning environment so that each attendee of a learning session in the space can have simultaneous essentially direct lines of sight to at least one of common presentation board and to any one of the other students in the space. To this end, in at least some cases, first, second and third large common presentation boards that have flat image presentation surfaces that are perpendicular to first, second and third trajectories, are mounted within the classroom space so that the first, second and third trajectories make substantially 120 degree angles (i.e., 100 to 140 degree angles) with each other and the tables are located within the space so that length dimensions thereof are angled with respect to the first presentation board. Here, student chairs are arranged along the long edges of the tables which facilitates the simultaneous direct line views to other students as well as to the common information on at least one of the displays.

Consistent with the above, at least some embodiments include a learning environment having a plurality of tables and a plurality of technology display devices distributed about the environment for use by occupants of the learning environment, the environment including a central area, the learning environment comprising at least first, second and third technology display devices that include first, second and third substantially flat display surfaces, respectively, for displaying information to occupants in the environment, the first, second and third displays supported in spaced radial relationship about the environment with the flat display surfaces substantially facing the central area and at least first, second and third elongated tables that have first, second and third elongation axis, respectively, the tables arranged in spaced radial orientations around the environment with the elongation axis substantially extending toward the central area and so that open spaces are formed between adjacent tables for standing occupants, wherein the second and third elongation axis form angles with the second and third display surfaces in the range between seventy-five and ninety degrees.

In at least some cases the first elongated axis forms an angle with the first display surface that is in the range of between seventy-five and ninety degrees. In some cases the angles between the first, second and third elongation axis and the first, second and third display surfaces are approximately ninety degrees. In some embodiments the first, second and third display trajectories are perpendicular to the first, second and third display surfaces, respectively, and wherein the first, second and third displays are supported at the corners of a triangle within the environment so that the first and second display trajectories form an angle between the range of 100 and 130 degrees, the second and third display trajectories form an angle between the range of 100 and 130 degrees and wherein the third and first display trajectories form an angle between the range of 100 and 130 degrees.

In some embodiments each of the angles between the first and second display trajectories, the second and third display trajectories and the third and first display trajectories is substantially 120 degrees. In some cases the first table is positioned with the first elongation axis forming an angle between zero degrees and 20 degrees with the third elongation axis, the environment further including a fourth table having a fourth elongation axis, the fourth table positioned so that the fourth elongation axis forms an angle between zero degrees and 20 degrees with the second elongation axis. In some cases the first and third elongation axis are substantially parallel and wherein the second and fourth elongation axis are substantially parallel. In some cases the first elongation axis forms an angle with the second elongation axis in the range between seventy-five and ninety degrees.

Some embodiments further include a switcher and first, second, third and fourth floor boxes, each floor box including a video port for linking to a source device, each video port linked to the switcher, the switcher including separate outputs for each of the display devices for selectively linking the video ports to the display devices, the first, second, third and fourth floor boxes located within the environment proximate the first, second, third and fourth tables for linking source devices at the first, second, third and fourth tables to the first, second and third display devices.

In some cases, the environment further includes a fourth technology display device supported in spaced radial relationship about the environment and with respect to the first through third display devices, the fourth display device having a fourth substantially flat display surface that substantially faces the central area. In some cases the first and third display surfaces substantially face each other and wherein the second and fourth display surfaces substantially face each other. In some cases the first, second, third and fourth display trajectories are perpendicular to the first, second, third and fourth display surfaces, respectively, and wherein the first and second display trajectories form an angle between the range of 75 and 105 degrees, the second and third display trajectories form an angle between the range of 75 and 105 degrees, the third and fourth display trajectories form an angle between the range of 75 and 105 degrees and the fourth and first display trajectories form an angle within the range between 75 and 105 degrees.

Some embodiments also include a fourth table having a fourth elongation axis, wherein the first and fourth elongation axis form angles with the first and fourth display surfaces in the range between seventy-five and ninety degrees. In some cases the wherein the first, second, third and fourth elongation axis form substantially ninety degree angles with the first, second, third and fourth display surfaces, respectively.

In some cases the environment resides within a rectangular space having first, second, third and fourth corners and first, second, third and fourth boundaries between the first and second corners, the second and third corners, the third and fourth corners and the fourth and first corners, respectively, the second and third display devices supported at the second and third corners, respectively. In some cases first display device is supported substantially midway along the fourth boundary.

Some embodiments further include first and second whiteboards supported substantially midway along the first and third boundaries, respectively. In some cases each of the first and second whiteboards includes a substantially flat whiteboard surface that has height and width dimensions of at least four feet and at least five feet, respectively. Some embodiments further include first and second cameras supported adjacent the first and second whiteboard surfaces for capturing images of information applied to the whiteboard surfaces. In some cases the first, second, third and fourth boundaries have first, second, third and fourth boundary length dimensions that are less than forty-five feet, respectively. In some cases the first, second, third and fourth boundary length dimensions are less than 35 feet. In some cases each of the display surfaces has height and width dimensions of at least three feet and at least four feet, respectively. In some cases each of the display surfaces has height and width dimensions of substantially four feet and substantially five feet, respectively. In some cases the first, second and third tables have first, second and third table length dimensions and wherein each of the table length dimensions is at least six feet. In some cases each of the table length dimensions is substantially eight feet.

In some cases the first, second and third display devices include first, second and third projectors that project images onto the first, second and third display surfaces, respectively. In some cases at least one of the display devices further includes an interactive whiteboard that forms the display surface. In some cases the second and third display devices includes first and second interactive whiteboards, respectively.

Other embodiments include a learning environment located within a space wherein the space has first, second, third and fourth corners and first, second, third and fourth boundaries between the first and second corners, the second and third corners, the third and fourth corners and the fourth and first corners, respectively, the space including first and second substantially equally sized lateral rectangular space areas adjacent the first and third boundaries, respectively, and also including a central area, the environment comprising first and second elongated tables that have first and second table length dimensions, respectively and first, second and third image presentation devices that include substantially flat first, second and third presentation surfaces, respectively, the first and second tables positioned in the first and second lateral areas so that the first and second table length dimensions are aligned with first and second table trajectories that form angels with adjacent boundaries that are within a range of between 30 degrees and 60 degrees, the first presentation device is supported along the first boundary substantially midway between the first and fourth corners with the first presentation surface generally facing the central area, the second presentation device is supported proximate the second corner with the second presentation surface forming an angle between 75 and 90 degrees with the first table trajectory and the third presentation device is supported proximate the third corner with the third presentation surface forming an angle between 75 and 90 degrees with the second table trajectory.

In some cases the first lateral area include first and second corner areas adjacent the first and second corners, respectively, the second lateral area include third and fourth corner areas adjacent the third and fourth corners, respectively, the first and second tables are positioned within the second and third corner areas, respectively, the environment further including at least a third table that includes a third table length dimension wherein the third table is positioned in at least one of the first and fourth corner areas and so that the third table length dimension is aligned with a third table trajectory. In some cases each of the boundaries is less than 45 feet. In some cases each of the boundaries is less than 35 feet. In some cases n each of the first and fourth boundaries has a similar length dimension and wherein the first boundary is substantially 30 feet. In some cases the presentation devices have height and width dimensions of at least three feet and four feet, respectively. In some cases the presentation devices have height and width dimensions of substantially four feet and substantially five feet, respectively.

In some cases the tables have table length dimensions that are substantially eight feet. In some cases the third table is positioned within the first corner area, the environment further including a fourth elongated table that has a fourth table length dimension and that is positioned in the fourth corner area. In some cases the first, second, third and fourth table trajectories form angels with adjacent boundaries that are substantially 45 degrees. In some cases the second presentation surface forms angles with each of the first and second boundaries that are between 30 and 60 degrees and wherein the third presentation surface forms angles with each of the second and third boundaries that are between 30 and 60 degrees.

In some cases the angles formed between the second presentation surface and the first and second boundaries and the angles formed between the third presentation surface and the second and third boundaries are substantially 45 degrees. In some cases the first, second and third presentation devices include first, second and third projectors that project images onto the first, second and third presentation surfaces, respectively. In some cases the second and third presentation devices include first and second interactive whiteboards where the first and second whiteboards form the second and third presentation surfaces, respectively.

Some embodiments include a method for arranging a learning environment having a plurality of tables and a plurality of technology display devices distributed about the environment for use by occupants of the learning environment, the environment including a central area, the method comprising the steps of providing at least first, second and third technology display devices that include first, second and third substantially flat display surfaces, respectively, for displaying information to occupants in the environment, providing at least first, second and third elongated tables that have first, second and third elongation axis, respectively, positioning the first, second and third displays in spaced radial relationship about the environment with the flat display surfaces substantially facing the central area and positioning the tables in spaced radial orientations around the environment with the first, second and third elongation axis substantially extending toward the central area and so that open spaces are formed between adjacent tables for standing occupants, wherein the second and third elongation axis form angles with the second and third display surfaces in the range between seventy-five and ninety degrees, respectively.

Still other embodiments include a method for arranging a learning environment having a plurality of tables and a plurality of technology display devices distributed about the environment for use by occupants of the learning environment, the environment including a space wherein the space has first, second, third and fourth corners and first, second, third and fourth boundaries between the first and second corners, the second and third corners, the third and fourth corners and the fourth and first corners, respectively, the space including first and second substantially equally sized rectangular space lateral areas adjacent the first and third boundaries, respectively, and also including a central area, the method comprising the steps of providing first and second elongated tables that have first and second table length dimensions, respectively, providing first, second and third image presentation devices that include substantially flat first, second and third presentation surfaces, respectively, positioning the first and second tables in the second and third corner areas so that the first and second table length dimensions are aligned with first and second table trajectories that form angels with adjacent boundaries that are within a range of between 30 degrees and 60 degrees, positioning the first presentation device along the first boundary substantially midway between the first and fourth corners with the first presentation surface generally facing the central area, positioning the second presentation device proximate the second corner with the second presentation surface forming an angle with the first table trajectory of between 75 and 90 degrees and positioning the third presentation device proximate the third corner with the third presentation surface forming an angle with the second table trajectory of between 75 and 90 degrees.

Still other embodiments include a learning environment having a plurality of tables and a plurality of technology display devices distributed about the environment for use by occupants of the learning environment, the environment including a central area, the learning environment comprising first, second and third technology display devices that include first, second and third substantially flat display surfaces, respectively, for displaying information to occupants in the environment, first, second and third display trajectories substantially p[perpendicular to the first, second and third display surfaces, respectively, the first, second and third displays supported at the corners of a triangle in spaced radial relationship about the environment with the flat display surfaces substantially facing the central area so that the first and second display trajectories, the second and third display trajectories and the third and first display trajectories form angles within a range between 100 and 140 degrees and first, second, third and fourth elongated tables that have first, second, third and fourth elongation axis, respectively, the tables arranged in spaced radial orientations around the environment with the elongation axis substantially extending toward the central area and so that open spaces are formed between adjacent tables for standing occupants, wherein the second and third elongation axis form angles with the second and third display surfaces in a range between seventy-five and ninety degrees.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

DETAILED DESCRIPTION OF THE INVENTION

Figure 1:
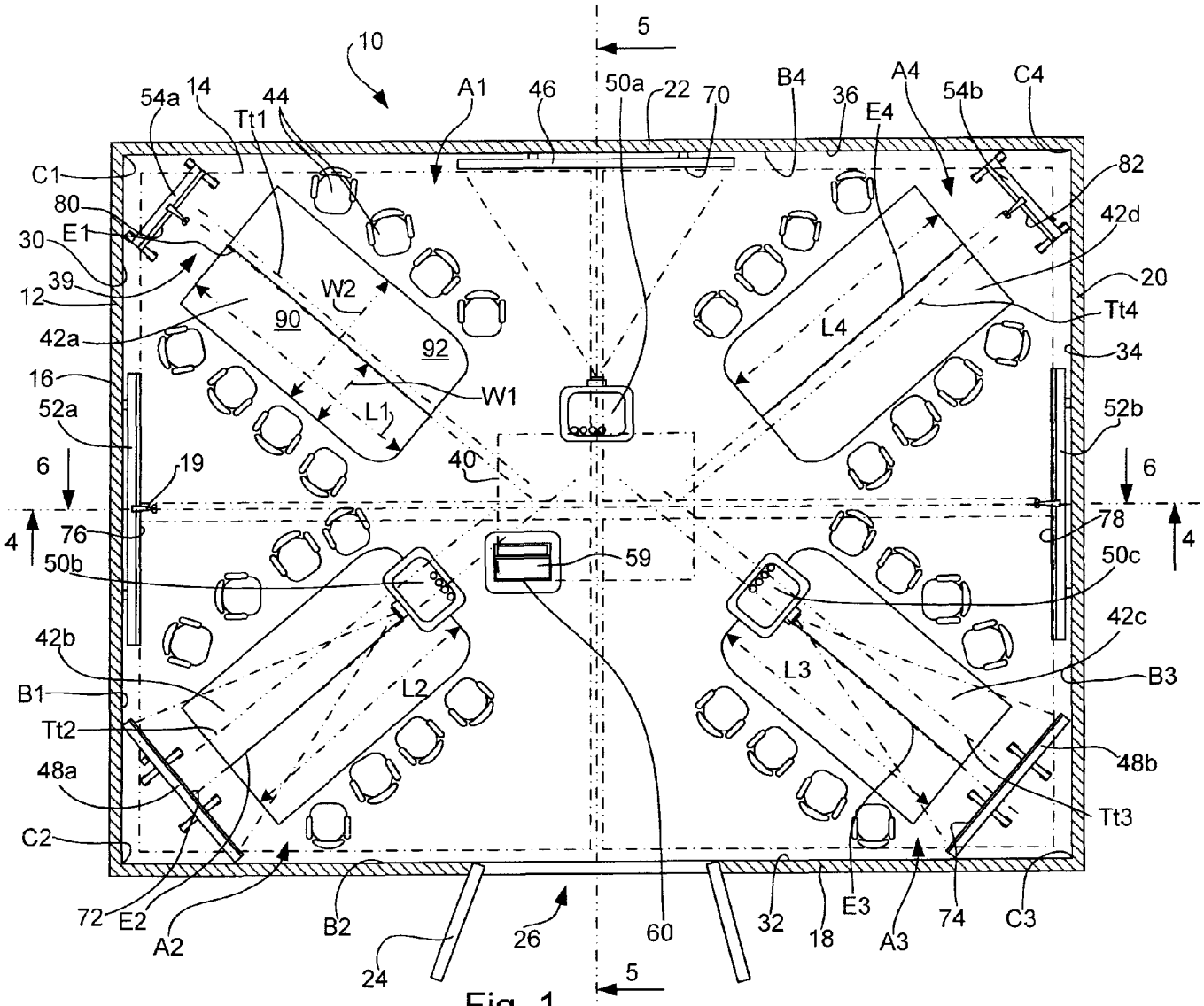
FIG. 1 is a top plan view of a classroom configuration that is consistent with at least some aspects of the present invention.

Referring now to the drawings wherein like reference numerals correspond to similar elements throughout the several views and, more specifically, referring to FIGS. 1 through 9, an exemplary classroom configuration or learning environment 10 for a plurality of occupants (not illustrated) that is consistent with at least some aspects of the present invention is illustrated. In general, configuration 10 includes a plurality of elongated tables, three technology display devices/presentation devices/screens (i.e., a screen on which images can be projected or otherwise displayed in a dynamic fashion (e.g., via a flat screen monitor or the like) and several whiteboards that are arranged in a radial fashion about a central area 40 of a space 14. There are spaces between each two adjacent tables for an instructor or the like to use when communicating with attendees in space 14.

Space 14 is a rectangular conference or classroom or learning space that, in the illustrated embodiment, is defined by a wall structure 12 including a first wall 16, a second wall 18, a third wall 20 and a fourth wall 22. A door 24 is mounted within an egress 26 that is formed in second wall 18 about mid-way along the length thereof. Walls 16, 18, 20 and 22 have internal surfaces 30, 32, 34 and 36, respectively, where surfaces 30 and 34 are parallel and face each other and surfaces 32 and 36 are parallel and face each other. The space 14 includes first, second, third and fourth corners C1, C2, C3 and C4, respectively. Internal wall surfaces 30, 32, 34 and 36 form first, second, third and fourth boundaries B1, B2, B3 and B4, respectively, that together circumscribe conference space 14 where first boundary B1 extends between corners C1 and C2, second boundary B2 extends between corners C2 and C3, third boundary B3 extends between corners C3 and C4 and fourth boundary B4 extends corners C4 and C1.

Figure 2:
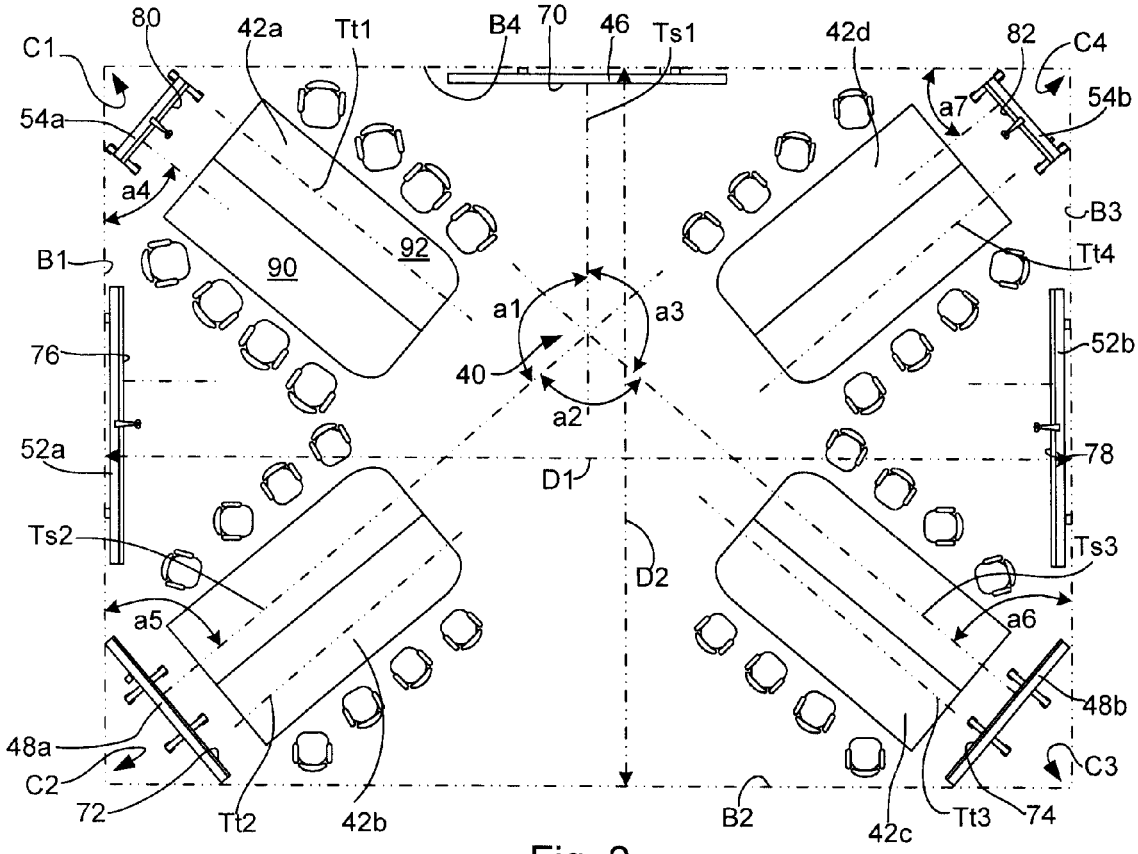
FIG. 2 is similar to FIG. 1, albeit showing the classroom configuration in a generally open space that is not defined by wall structure.

As seen in FIG. 2, space 14 has first and second length dimensions D1 and D2, respectively. Here, each of the length dimension D1 and length dimension D2 is less than forty-five feet. In particularly advantageous embodiments length dimension D1 is less than thirty feet and length dimension D2 is less than thirty-five feet. Here, first and second length dimensions D1 and D2, respectively, are not generally arbitrary and are limited as a function of the dimensions of large presentation screens (e.g., 46, 48*a*, 48*b*, etc.) to be used within the space 14. Dimensions D1 and D2 need to be selected so that, from any location within space 14, a class attendee viewing the front surface of any one of the large presentation screen can relatively easily (e.g., without straining eyes) see information presented thereon. In this regard, it has been recognized that, where large presentation screens have height dimensions between three and seven feet and width dimensions between four and eight feet, a typical projected image can be viewed well from a range of forty-five feet or less and very well from less than thirty feet. Thus, dimensions D1 and D2 are limited to less than forty-five feet and in advantageous cases to thirty-five feet or less.

Referring still to FIG. 1, in general, space 14 can be divided into first and second rectangular lateral areas including the left and right hand halves of space 14 as illustrated in FIG. 1 or into first, second, third and fourth rectangular and substantially similarly dimensioned areas A1, A2, A3 and A4, respectively, that are located proximate first, second, third and fourth corners C1, C2, C3 and C4, respectively. A central location or area within space 14 is shown in phantom and labeled 40 in FIG. 1. Referring still to FIG. 1, the first furniture configuration 10 includes first, second, third and fourth table assemblies 42*a*, 42*b*, 42, 42*c* and 42*d*, respectively, a plurality of chairs, two of which are identified in FIG. 1 by numeral 44, a single projector screen 46, first and second interactive whiteboards 48*a* and 48*b*, respectively, first, second and third drivers or projectors 50*a*, 50*b* and 50*c*, respectively, first and second large whiteboard/camera assemblies 52*a* and 52*b*, respectively, first and second small whiteboard/camera assemblies 54*a* and 54*b*, respectively, and a control cart 60.

Figure 7:
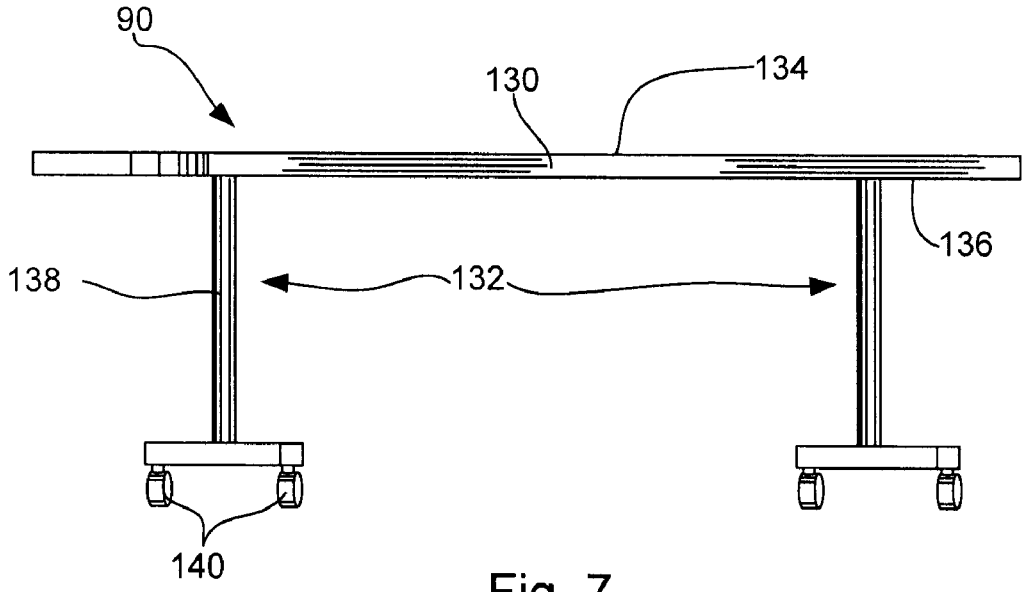
FIG. 7 is a side view of one of the table of FIG. 1.

Referring still to FIG. 1, each of table assemblies 42*a*, 42*b*, 42*c* and 42*d* is similar constructed and operates in similar fashion and therefore, in the interest of simplifying this explanation, only table assembly 42*a* will be described in detail. Referring also to FIG. 2, table assembly 42*a* includes first and second tables 90 and 92, respectively. Here, each of tables 90 and 92 is similarly constructed and is used in a similar fashion and therefore, again, in the interest of simplifying this explanation, only table 90 will be described here in detail. Referring also to FIG. 7, table 90 includes a rigid top member 130 and two table legs that are collectively identified by numeral 132. As best seen in FIG. 1, top member 130 is generally rectangular and has length and width dimensions L1 and W1, respectively. At one corner, top member 130 is rounded while the other three corners form right angles. As best seen in FIG. 7, top member 130 has oppositely facing and parallel top and bottom surfaces 134 and 136, respectively.

Each of legs 132 includes a substantially vertical leg structure 138 that extends between top and bottom ends. Wheels 140 are provided at the bottom end of each of leg structures 138. Under surface 136 of top member 130 is secured to the top ends of leg structures 138. Thus, because table 90 includes wheels 140, table 90 can easily be rolled about within conference space 14 to facilitate different conference room configuration.

Referring specifically to FIG. 1, in at least some cases, tables 90 and 92 can be positioned so that the long straight edges thereof abut each other and so that a combined width W2 of the tables 90 and 92 results. In at least some embodiments first table length dimension L1 is between 7 and 10 feet while width dimension W2 is between 3 and 5 feet. In particularly advantageous embodiments dimension L1 is 8 feet while width dimension W2 is substantially 4 feet. Here, these advantageous dimensions provide a table top surfaces 134 (see again FIG. 7) that is large enough to comfortably accommodate between six and eight table users, three to four users positioned along each of the long edges of the table assembly 42*a* as shown in FIG. 1. Other table assemblies 42*b*, 42*c* and 42*d* have second, third and fourth table length dimensions L2, L3 and L4, respectively, that are identical to length L1. As seen in FIG. 1, tables 42*a*, 42*b*, 42*c*, and 42*d* have first through fourth elongation axis E1, E2, E3, and E4 that extend along the length dimensions L1, L2, L3, and L4 respectively (see also FIG. 1).

Figure 8:
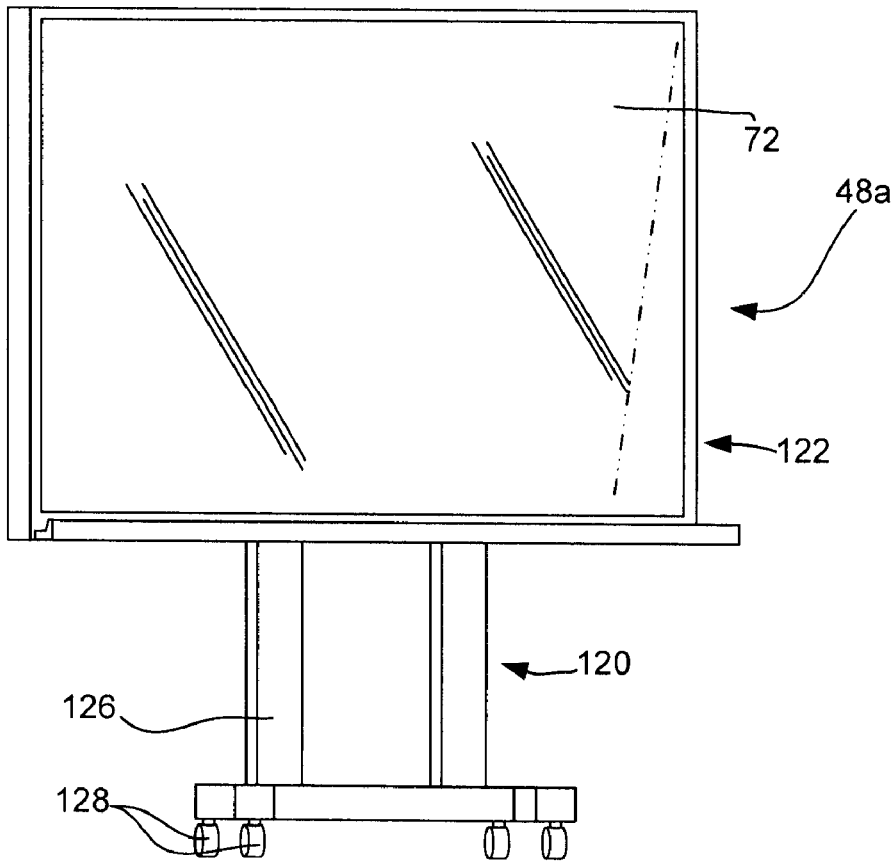
FIG. 8 is a side view of one of the interactive whiteboards of FIG. 1.

Referring still to FIG. 1 and now also to FIG. 8, each of the interactive whiteboards 48*a* and 48*b* is similarly constructed and operates in a similar fashion and therefore, in the interest of simplifying this explanation, only whiteboard 48*a* will be described in detail. Whiteboard 48*a* includes a touch sensitive whiteboard assembly 122 that is mounted to a cart 120. Cart 120 includes leg support structure 126 that has top and bottom ends. Wheels 128 are mounted at the bottom end of leg structure 126. Touch sensitive whiteboard assembly 122 is mounted at the top ends of leg structure 126.

Whiteboard assembly 122 may take any of several different forms but, in general, includes structure that forms a substantially flat and rectangular front whiteboard presentation surface 72 on which a whiteboard user can apply information. In addition, surface 72 can operate as a presentation screen on which information can be projected via projector 50*b*. Surface 72 has height dimension H3 between three and five feet and width dimension W5 between four and eight feet. In particularly advantageous embodiments height and width dimensions H3 and W5 are approximately four and five feet, respectively.

In at least some cases, conventional ink type pens can be used to apply information to surface 72 while in other cases, "virtual" ink is projected onto surface 72 via projector 50*b* (see again FIG. 1) as a board user performs actions intended to alter the image on surface 72. Touch sensitive or interactive whiteboards and projector combinations are well known in the art and therefore will not be described here in detail. For example, the TS Lightning interactive whiteboard that is manufactured by PolyVision is one exemplary product that may comprise whiteboard 122. Here, it should suffice to say that as a whiteboard user interacts with surface 72 to either apply information thereto, remove information therefrom or select icons displayed (e.g., projected) thereon, sensors (not illustrated) within whiteboard assembly 122 sense the activities, determine the types of activities being performed and then perform processes that are consistent with the activities that occur. Thus, for instance, where a user uses her finger to draw a red circle on surface 72, the whiteboard assembly sensors sense movement of the user's finger and convert that movement to digital data representative of a red circle which, in the case of virtual ink, is projected via projector 50*b* onto surface 72. In the figures, numeral 74 is used to reference the presentation surface of interactive whiteboard 48*b*.

Figure 9:
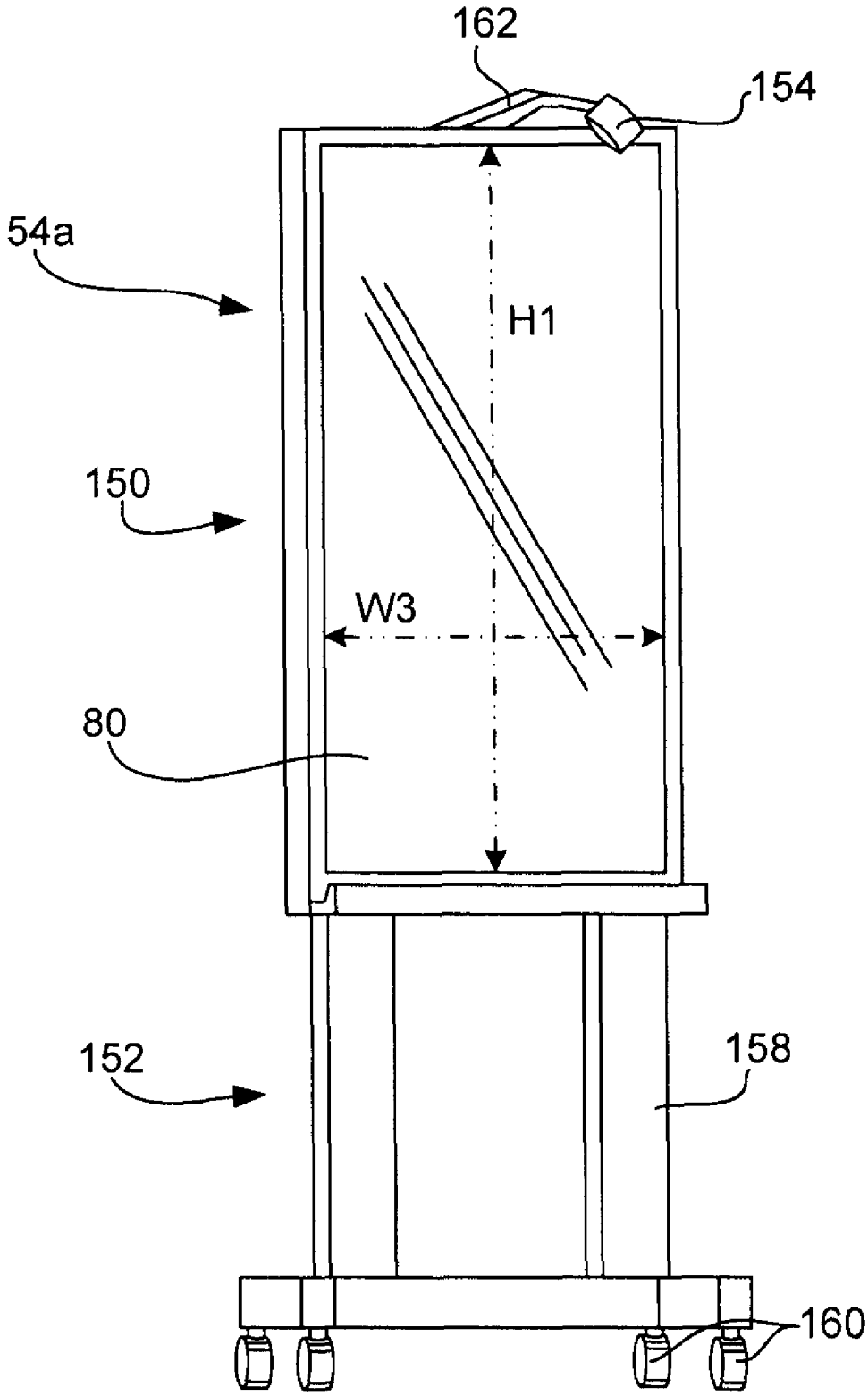
FIG. 9 is a side view of one of the interactive whiteboards/camera assemblies of FIG. 1

Referring once again to FIG. 1, each of the whiteboard/camera assemblies 54*a* and 54*b* is similarly constructed and operates in a similar fashion and therefore, in the interest of simplifying this explanation, only assembly 54*a* will be described here in detail. Referring also to FIG. 9, assembly 54*a* includes a whiteboard assembly 150, a cart 152, a camera 154 and a camera support arm 162. Cart 152 includes leg structure 158 that has top and bottom ends. Wheels 160 are mounted to the bottom end of leg structure 158. Whiteboard 150 is mounted to the top end of leg structure 158 and includes a front surface 80. Surface 80 has a height dimension H1 and a width dimension W3. In at least some embodiments height dimension H1 is between 4 and 6 feet while width dimension W3 is between 3 and 5 feet. In particularly advantageous embodiments, height dimension H1 is approximately 5 feet and width dimension W3 is approximately 3 feet.

Here, whiteboard 150 is not touch sensitive or interactive and instead includes a standard whiteboard structure to which ink may be applied and from which ink may be erased. Arm 162 is mounted to the top end of whiteboard 150 and camera 154 is mounted to a distal end of arm 162 so that a lens of camera 154 is focused on front surface 80 of board 150. Here, after ink has been applied to surface 80 to form an image thereon, a board user can cause camera 154 to create a digital image of the information on surface 80 which can then be digitally stored and/or projected onto display screens within conference space 14 as described in greater detail below.

Referring once again to FIG. 1, whiteboard/camera assemblies 52*a* and 52*b* are similar to the whiteboard/camera assembly 54*a* described above with respect to FIG. 9. The primary differences between assemblies 54*a* and 54*b* on one hand and assembly 52*a* on the other hand are that assemblies 52*a* and 52*b* are wall mounted instead of being mounted to a cart (see 152 in FIG. 9) and assemblies 52*a* and 52*b* are larger than assembly 54*a*. In this regard, referring also to FIG. 5, assembly 52*a* forms a flat whiteboard surface 76 that has height and width dimensions H2 and W4. In at least some embodiments, height dimension H2 is between 4 and 7 feet, while width dimension W4 is between 6 and 9 feet. In particularly advantageous embodiments, the height H2 and width W4 dimensions are 6 and 8 feet, respectively. An exemplary camera and support arm combination is shown at 19 in FIG. 1 for assembly 52*a*.

Figure 4:
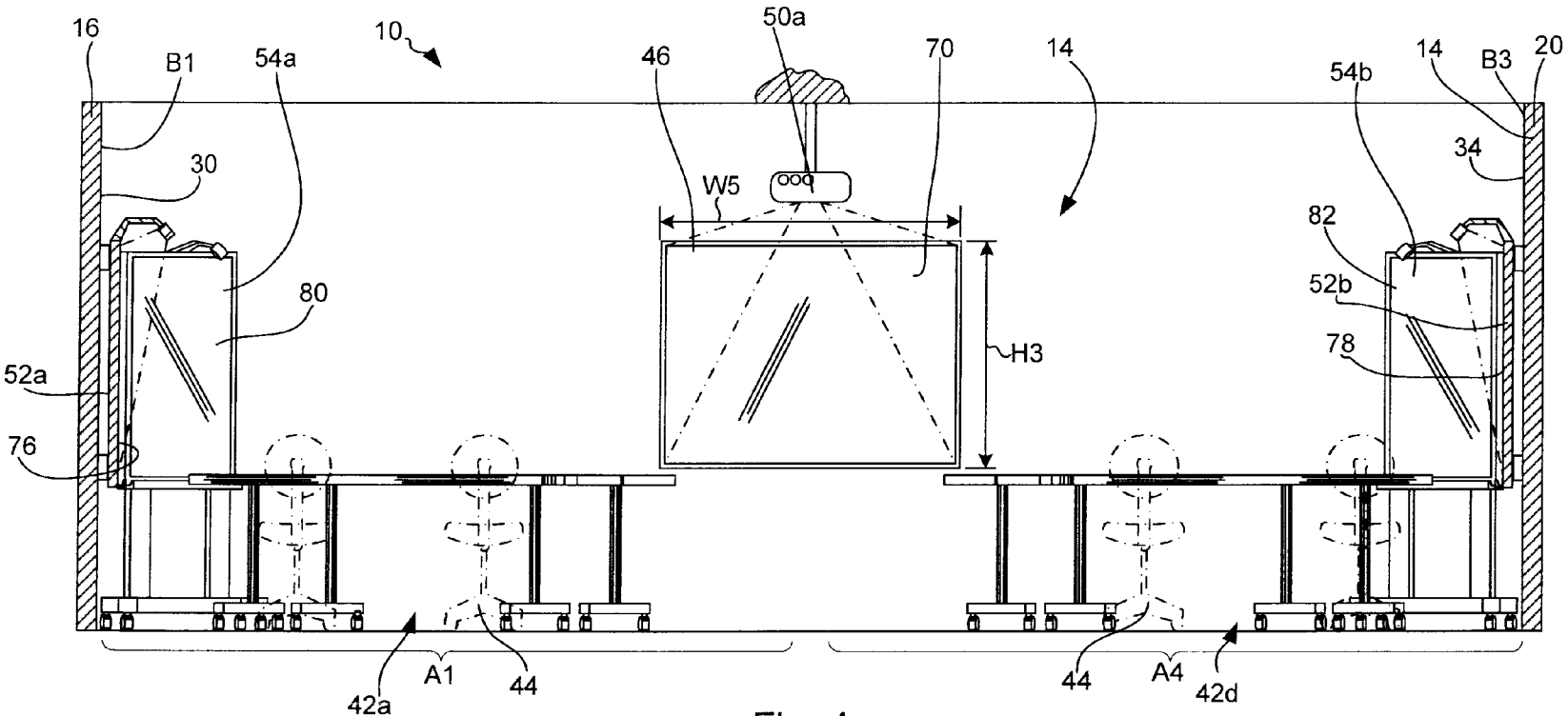
FIG. 4 is a cross-sectional view taken along the line 4-4 of FIG. 1.

Referring once again to FIG. 1 and also to FIG. 4, projection screen 46, as the label implies, is a large screen on which images can be projected via projector 50*a*. In the illustrated embodiment, screen 46 is rectilinear, forms a front presentation surface 70 and is wall mounted. Surface 70 has height and width dimensions H3 and W5, respectively. In at least some embodiments height H3 is between 3 and 5 feet and width W5 is between 4 and 7 feet. In particularly advantageous embodiments, height H3 and width W5 are approximately 4 and 5 feet, respectively. Here, it should be appreciated that, in at least some embodiments, screen 46 may be foregone and images may be projected directly onto internal surface 36 so that the portion of surface 36 subtended by the projected image operates as a presentation board. In the illustrated embodiment board 46 is provided as a distinct component to facilitate understanding of the overall configuration.

Figure 5:
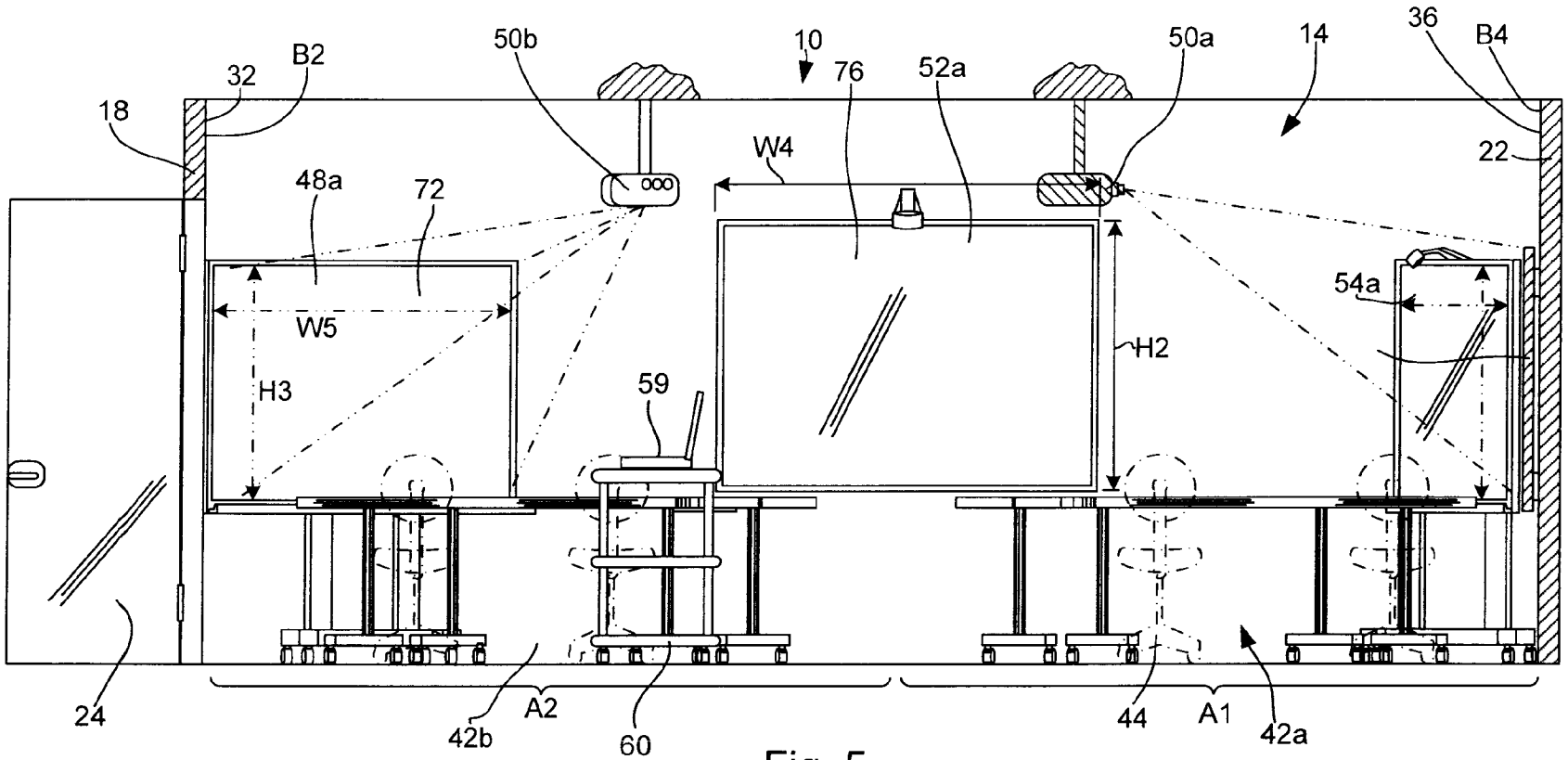
FIG. 5 is a cross-sectional view taken along the line 5-5 of FIG. 1.
Figure 6:
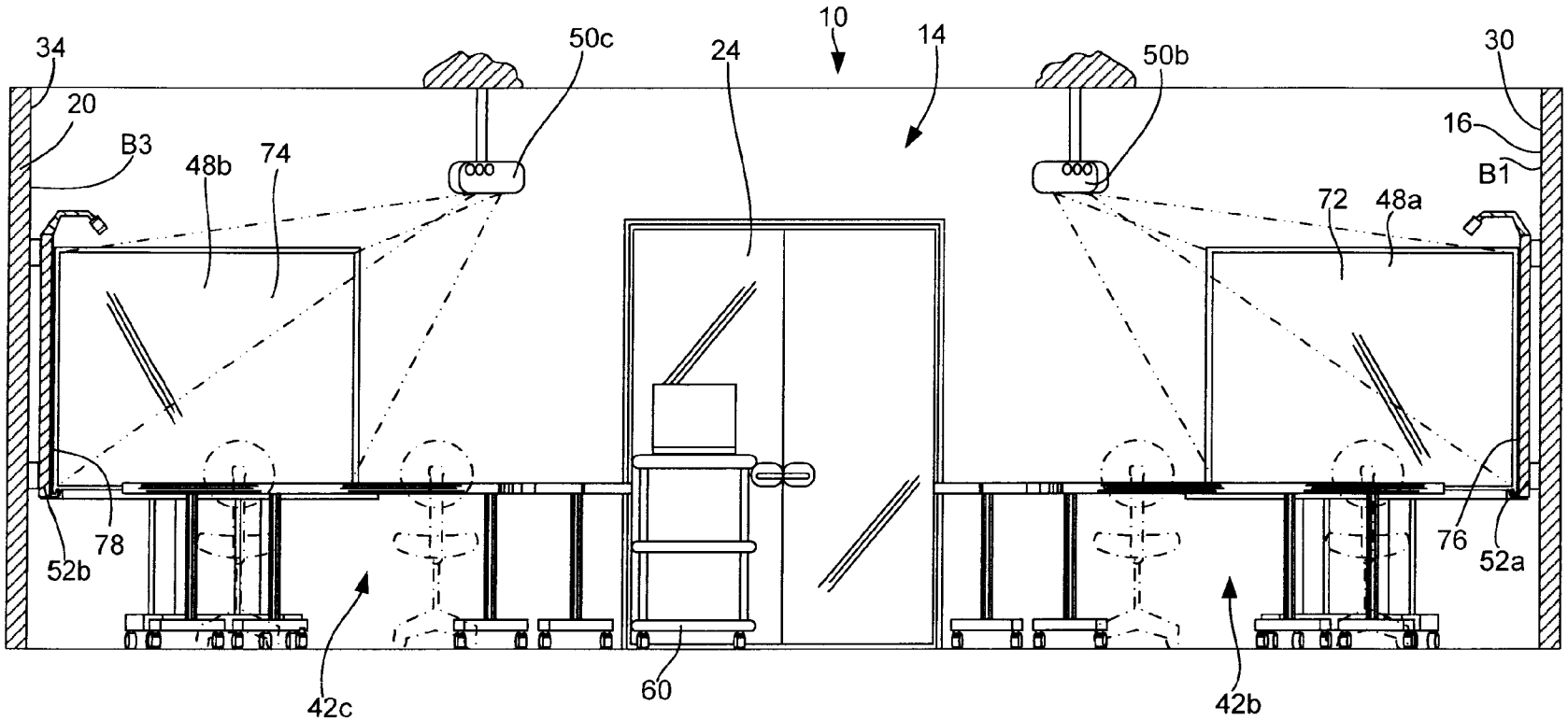
FIG. 6 is a cross-sectional view taken along the line 6-6 of FIG. 1.

Referring yet again to FIG. 1, projectors 50*a*, 50*b* and 50*c* are conventional front projection units. As seen in FIGS. 5 through 6, projectors 50*a*, 50*b* and 50*c* are mounted via posts (not labeled) to a ceiling structure over space 14. Control cart or podium 60 is simply a cart that can be used by a teacher or primary conference facilitator during classroom or conferencing activities. To this end, the cart forms a top surface on which, in the present example, a laptop computer 59 rests. Here, it is contemplated that computer 59 may be wirelessly linked or hard wired to a controller for controlling the sources of information being projected by projectors 50*a*, 50*b* and 50*c*. Thus, software loaded on laptop 59 may be usable to select laptop 59 as the source for information projected by all three projectors 50*a*, 50*b* and 50*c*. In the alternative, the software may allow selection of any laptop or other electronic device within space 14 for driving projectors 50*a*, 50*b* and 50*c*. As yet another alternative, laptop 59 may be usable to select different sources for independently driving each of projectors 50*a*, 50*b* and 50*c* with different information. For example, the first laptop (not illustrated) at table assembly 42*b* may be used to drive projector 50*b* while a second laptop located at table 42*c* may be used to drive projector 50*c* and laptop 59 may be used to drive projector 50*a*. In addition, in at least some embodiments, laptop 59 may be programmed to control the cameras associated with one or a subset of the whiteboard/camera assemblies 52*a*, 52*b*, 54*a* and 54*b*. Here, once an image is captured via one of the whiteboard/camera assemblies, that image may be digitally stored and/or presented via one or all of the projectors 50*a*, 50*b* and 50*c*.

Although not shown, it should be appreciated that other devices may be used instead of laptop 59 for controlling projected images. For instance, a dedicated graphical interface device that allows an instructor or the like to select projector inputs is contemplated. More explanation of an exemplary source and projector selection system is described in greater detail below with respect to FIG. 19.

Referring now to FIGS. 1 through 6, exemplary configuration 10 includes projection screen 46 mounted to the interior surface 36 of fourth wall 22 substantially midway between corners C1 and C4 with front surface 70 generally facing interior surface 32 of second wall 18. Thus, screen 46 is mounted along fourth boundary B4. Assembly 52*a* is mounted to internal surface 30 of first wall 16 approximately midway between corners C1 and C2 so that front surface 76 faces interior surface 34 of wall 20 and thus assembly 52*a* is mounted along first boundary B1. Similarly, assembly 52*b* is mounted to internal surface 34 of wall 20 approximately midway between corners C3 and C4 so that front surface 78 faces interior surface 30 of wall 12 and therefore assembly 52*b* is supported along third boundary B3.

First interactive whiteboard 48*a* is positioned proximate corner C3 and is angled so that front presentation surface 72 faces central location 40 (see FIG. 1). Similarly, interactive whiteboard 48*b* is positioned proximate third corner C3 and is angled so that front surface 74 faces central location 40. First, second and third screen trajectories Ts1, Ts2 and Ts3, respectively, are perpendicular to the front surfaces 70, 72 and 74 of screen 46 and whiteboards 48*a* and 48*b*, respectively. When positioned in a manner consistent with at least some aspects of the present invention, the trajectories Ts1, Ts2 and Ts3 form first, second and third inter-board angles a1, a2 and a3, where each of the angles a1, a2 and a3 is between 100° and 130°. In particularly advantageous embodiments, each of angles a1, a2 and a3 is approximately 120°. Thus, screen 46 and assemblies 48*a* and 48*b* are supported about space 14 in a radially arranged fashion about central area 14 so that front surfaces thereof generally face central area 40.

Referring still to FIGS. 1 through 6, whiteboard/camera assembly 54*a* is positioned adjacent corner C1 and is angled so that front surface 80 thereof generally faces central location 40. Similarly, whiteboard/camera assembly 54*b* is positioned proximate corner C4 and is angled so that front surface 82 thereof generally faces central location 40.

Table assembly 42*a* is positioned within first space area A1. First table length dimension L1 is aligned with a first table trajectory Tt1 that extends from first corner C1 toward a central location 40 where trajectory Tt1 defines angles (see a4 in FIG. 2) with adjacent boundaries within the range between thirty and sixty degrees). Here, because of the angle of surface 80, an angle formed between elongation axis E1 and surface 80 is between 75° and 90°. In advantageous embodiments angle a4 is approximately 45°. As illustrated in FIG. 1, a space 39 is left between assembly 54*a* and the adjacent edge of table assembly 42*a* where the space 39 is large enough to accommodate an attendee using assembly 54*a*.

Referring again to FIGS. 1 and 2, second table assembly 42*b* is positioned within second area A2 in a manner similar to the manner in which table assembly 42*a* is positioned in area A1. To this end, second length dimension L2 extends along a second table trajectory Tt2 that generally extends from second corner C2 toward central location 40 so that trajectory Tt2 forms an angle as with an adjacent space boundary that is similar to angle a4. Here, the second elongation axis E2 forms an angle with the front surface 72 of assembly 48*a* of between 75° and 90° and in particularly advantageous embodiments, of substantially 90°. Table 42*b* is spaced from interactive whiteboard 48*a* so that an attendee can get between front surface 72 of whiteboard 48*a* and the adjacent edge of table assembly 42*b*.

Referring still to FIGS. 1 and 2, third table assembly 42*c* and fourth table assembly 42*d* are positioned within space areas A3 and A4, respectively. Third table length dimension L3 is aligned with a third table trajectory Tt3 that generally extends from third corner C3 toward central location 40 and that forms an angle a6 with an adjacent boarder that is similar to angle a4. Here, the third elongation axis E3 forms an angle with the front surface 74 of assembly 48*b* of between 75° and 90° and, in particularly advantageous embodiments, of substantially 90°. The edge of table assembly 42*c* adjacent interactive whiteboard 48*b* is spaced therefrom so that a person can use whiteboard 48*b* at the end of table assembly 42*c*. Fourth table length dimension L4 is aligned with a fourth table trajectory Tt4 that generally extends from fourth corner C4 toward central location 40 and that forms an angle a7 with an adjacent boundary that is similar to angle a4. An angle between surface 82 and fourth elongation axis E4 is between 75° and 90°. Assembly 42*d* is spaced from assembly 54*b* so that a person can use assembly 54*b* at the end of table assembly 42*d*.

Thus, it should be appreciated that tables 42*a*-42*d* are radially arranged about central area 40 so that the elongation axis E1 through E4 extend generally toward corners C1 through C4 respectively. Spaces exist between each two adjacent tables in which an instructor can reside when lecturing. In at least some embodiments the tables are arranged so that the first elongation axis E1 forms an angle in the range between 0° and 20° with the third elongation axis E3 and so that the second elongation axis E2 and the fourth elongation axis E4 form an angle in the range between 0° and 20°. In at least some embodiments axis E1 and E3 are substantially parallel and axis E2 and E4 are substantially parallel.

Referring again to FIG. 1, eight chairs are arranged around each of table assemblies 42*a*, 42*b*, 42*c* and 42*d*, four chairs along each of the long edges of the table assemblies. Thus, in an advantageous configuration, no chairs are arranged along the relatively short edges of the table assemblies 42*a* through 42*b*.

Referring to FIGS. 1 through 6, projectors 50*a*, 50*b* and 50*c* are mounted to a ceiling structure over space 14 and, when turned on, project images on front surfaces 70, 72 and 74 of screen 46 and whiteboards 48*a* and 48*b*, respectively. Cart 60 is shown in FIG. 1 proximate central location 40 but, it should be understood, may be moved to any unoccupied location within conference space 14.

Figure 3:
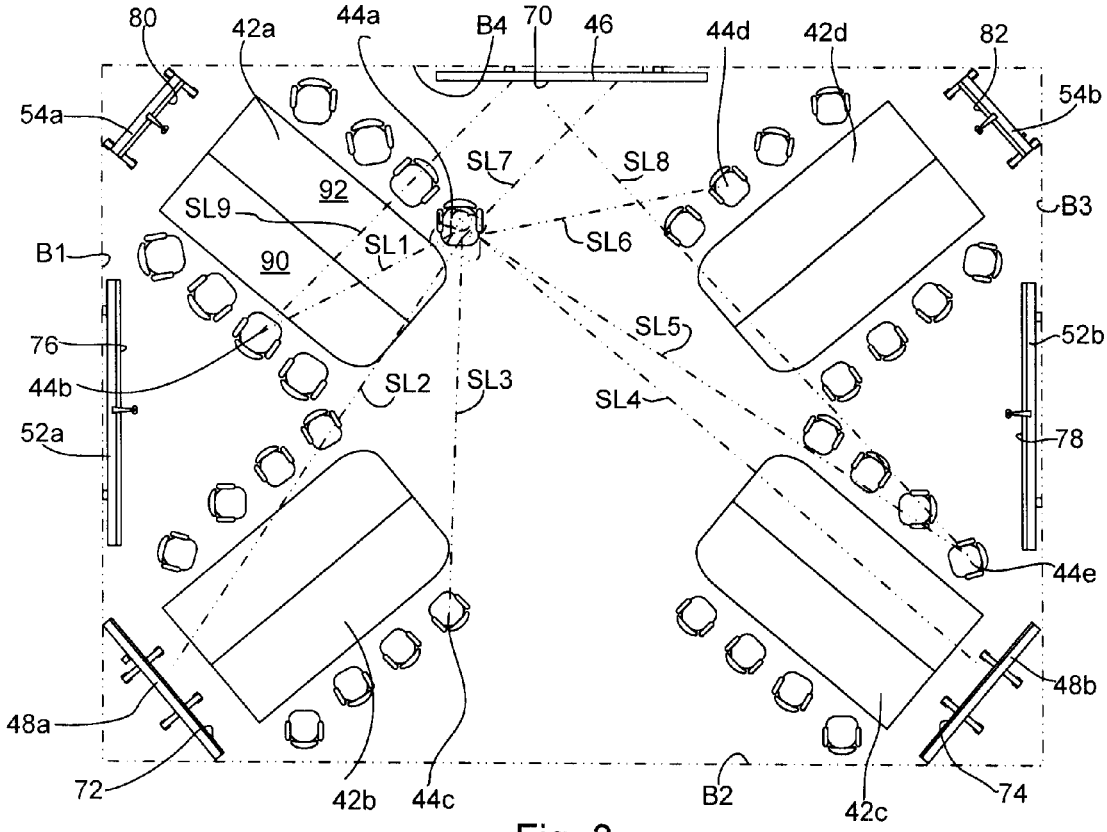
FIG. 3 is similar to FIG. 2, albeit including a plurality of exemplary site lines.

Referring still to FIGS. 1 through 6 and more specifically to FIG. 3, during large group discussions it is contemplated that projectors 50*a*, 50*b* and 50*c* will be used to simultaneously display identical information on each of screen 46 and whiteboards 48*a* and 48*b* for all conference attendees located within space 14. Here, as discussions occur, because of the layout of the tables, each attendee that occupies the chair 44 has a relatively good line of sight to any of the other attendees within space 14. Thus, for instance, referring to FIG. 3, an attendee in chair 44*a* has a clear line of sight SL1 to an attendee in chair 44*b* as well as a clear line of sight SL3 to an attendee in chair 44*c* and a clear line of sight SL6 to an attendee in chair 44. Similarly, a person in chair 44*a* has a relatively unobstructed line of sight SL5 to a person occupying chair 44*e*.

In addition, it should be appreciated that, irrespective of which other attendee within space 14 that an attendee in chair 44*a* turns to converse with or observe, the person in chair 44*a* will have a fairly good view of one of the surfaces to 70, 72 or 74 on which the common information is projected so that, with a minor turn of her head or redirecting of her eyes, she can reference the common information. Thus, for instance, while an attendee in chair 44*a* addresses another attendee in chair 44*b*, the attendee in 44*a* can redirect her eyes slightly to the left to view and reference the common displayed image on surface 72. Moreover, at the same time, the attendee in chair 44*b* can redirect his eyes from the attendee in chair 44*a* slightly to the left to refer to the common information projected on surface 70. Exemplary lines of sight to surfaces 72 and 70 are identified as SL2 and SL9, respectively.

Referring still to FIG. 3, in a similar fashion, when an attendee in chair 44*a* addresses the attendee in chair 44*c*, the attendee in chair 44*a* can divert her eyes slightly to the right to reference the common information along sight line SL2 and the attendee in chair 44*c* simply has to peer over the shoulder of the attendee in chair 44*a* to surface 70 to reference the common information. Moreover, when the attendee in chair 44*a* is addressing the attendee in 44*e* and visa versa, the attendees in chairs 44*a* and chair 44*e* can simply redirect their sights slightly to the right of the other attendee being addressed along sight lines SL4 and SL8 to reference common information on surfaces 74 and 70, respectively.

Here, it should be appreciated that regardless of the chair occupied by a first attendee, when the first attendee addresses a second attendee in any other chair within space 14, each of the attendees can have relatively direct lines of sight to each other and can also have a relatively direct line of sight to the commonly displayed information on one of screen 46 or whiteboards 48*a* or 48*b* without having to turn away from the other attendee being addressed.

Referring still to FIGS. 1 through 6, an instructor or general conference attendee may, at times, want to create images for the entire group of attendees within conference space 14. To this end, the instructor can move to one of the large whiteboard/camera assemblies 52*a* or 52*b* and use conventional ink pens to apply information to one of the surfaces 76 or 78. When the information applied to one of the surfaces 76 or 78 is important enough to archive, the instructor can cause the camera associated with the assembly (e.g., 52*a*) to generate and store a digital picture or images thereof. In addition, if desired, once a picture of an image on one of surfaces 76 or 78 has been captured, that image may be projected onto any of front surfaces 70, 72 or 74. Similarly, an instructor may use one of assemblies 54*a* or 54*b* to create and capture a whiteboard image. Moreover, a teacher or other may use either of the interactive whiteboards 48*a* or 48*b* to create and capture an image or, in the alternative, to mark up the projected images or control a computer application when output of the application is projected onto one of the surfaces 72 or 74.

In addition to facilitating highly effective large group discussions, the configuration 10 shown in FIGS. 1 through 6 is also particularly suitable for facilitating small group activities. To this end, attendees at the four separate table assemblies 42*a*, 42*b*, 42*c* and 42*d* are naturally clustered into groups of 8 to facilitate quick break out sessions. Moreover, because of the juxtapositions of table assemblies 42*a*, 42*b*, 42*c* and 42*d* with respect to assembly 54*a*, interactive whiteboard 48*a*, interactive whiteboard 48*b* and assembly 54*b*, each of the small breakout groups is provided exclusive access to a whiteboard for facilitating small group activities. Moreover, because whiteboard images can be captured via each of assemblies 54*a*, 54*b* and whiteboards 48*a* and 48*b*, once small group activities have ceased and large group activities once again commence, the captured information can easily be shared with the larger group when appropriate.

At this point it should be appreciated that a versatile classroom configuration has been described for supporting and enhancing large group discussions as well as small group activities. Here, referring again to FIG. 1, because of the juxtaposition of tables and presentation screens as well as the relative dimensions of the screens and the classroom space as a whole, classroom attendees in any of the chairs can have a generally direct line of sight to any other attendee in space 14 and can view commonly displayed information easily irrespective of the current direction in which the attendee faces by simply redirecting a line of sight slightly. Thus, by limiting space 14 dimensions D1 and D2 to less than forty-five feet and in some cases to less than thirty-five feet, an environment results in which attendees are comfortable viewing commonly displayed images on any of the surfaces 70, 72 or 74 with minimal effort and attendees tend to face each other during large group discussion to a greater degree.

It should be also appreciated that, referring again to FIG. 1, when attendees at the assemblies 42*a*-42*d* are oriented along the long table edges to use the assemblies 42*a*-42*d*, none of the attendees has his/her back to central location 40. For this reason, when an instructor is located in central location 40, each attendee at one of the assemblies 42*a*-42*d* has a good line of sight to the instructor. Moreover, regardless of which of boards 52*a* or 52*b* an instructor uses to create an image, because of the limited space 14 dimensions and the table orientations, any attendee at one of assemblies 42*a*-42*d* should be able to view the image created with relative ease. Moreover, it should be appreciated that by triangulating the presentation screens, a configuration results that has the above advantages where only three presentation screens are required. By using only three screens instead of a larger number of screens, configuration costs are reduced while still providing the above advantages. In this regard, it has been recognized that, while four or more screens can further reduce the degree to which attendees need to redirect lines of sight from other attendees to view displayed information, the small reduction in redirection generally will not justify the added costs associated with the additional screens and associated drivers.

Referring again to FIG. 1, When small group activities are to occur, attendees are already grouped around suitable table assemblies to conduct the activities. In addition, each small group has a dedicated whiteboard for facilitating discussions.

Figure 10:
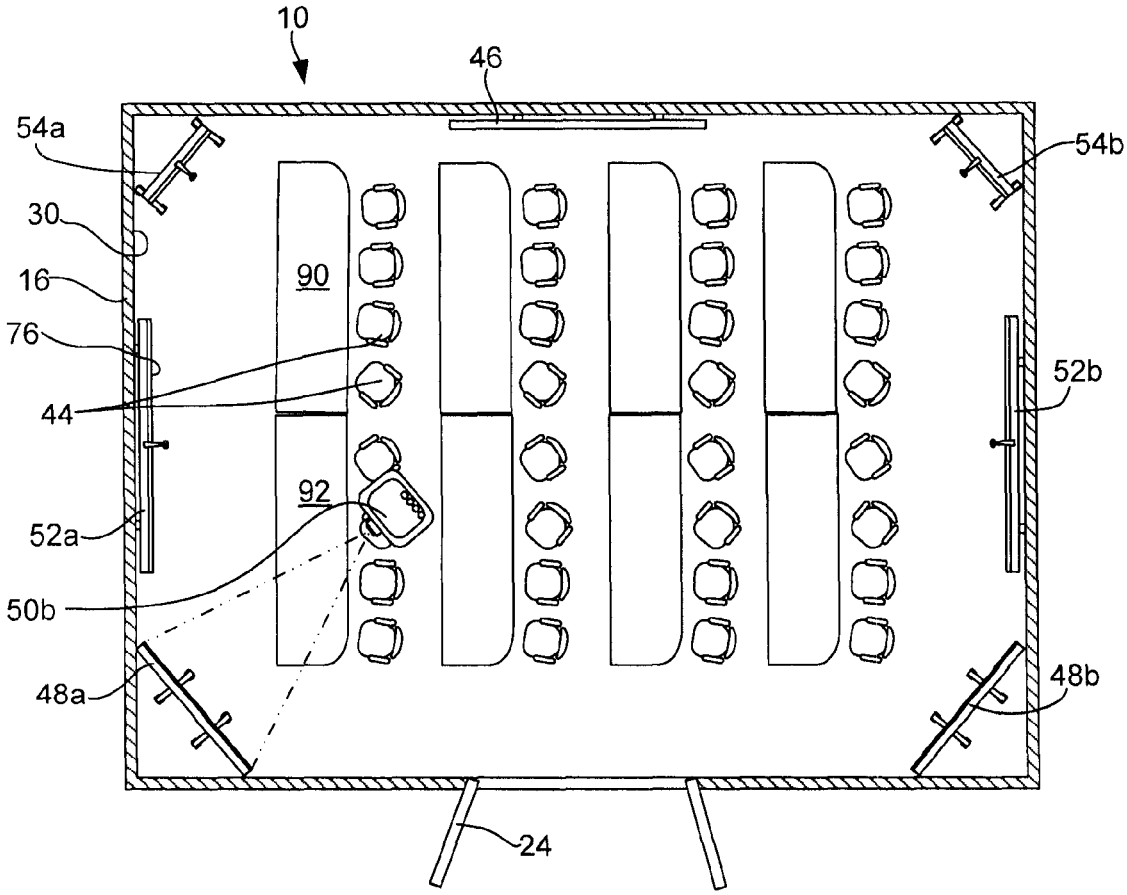
FIG. 10 is a view similar to FIG. 1, albeit where the tables and chairs included in the configuration have been arranged in a different format.

Referring once again to FIGS. 1 and 7, it should be appreciated that, because each table assembly 42*a*, 42*b*, 42*c*, and 42*d* includes first and second separate tables (e.g., 90 and 92) and each of the tables includes wheels or castors, the table assemblies can easily be split into eight separate tables and rearranged within space 14 where different table configurations are desired. To this end, referring now to FIG. 10, the tables and chairs of configuration 10 are shown in a second configuration 10 prime within space 14. Here, the separate tables that comprise each table assembly 42*a*, 42*b*, 42*c*, and 42*d* have been separated and (see 90 and 92 in FIG. 10) and have been arranged to form four separate rows of tables where each row includes two tables and the tables and occupants thereof are oriented such that the classroom or conference attendees generally face in a single direction toward the internal surface 30 of wall 16 and toward the front surface 76 of interactive whiteboard 52*a*. Here, the configuration 10 prime is suitable for a more conventional type classroom where a teacher occupies a space adjacent to front surface 76 of whiteboard 52*a* during a lecture or the like.

Referring yet again to FIG. 1, while certain types of presentation screens and whiteboards 46, 48*a*, 48*b*, 52*a*, 52*b*, 54*a* and 54*b* have been described above in the context of configuration 10, it should be appreciated that other combinations of screens and boards are contemplated here. For example, while each of whiteboards 54*a* and 54*b* are described above as having a camera attached thereto, in at least some embodiments, the cameras may be foregone in favor of a more conventional type of whiteboard. As another example, in at least some embodiments, none of the whiteboards 54*a*, 54*b*, 52*a* or 52*b* may be equipped with a camera. In fact, in some embodiments, configurations may only include whiteboards 48*a* and 48*b* and projector screen 46 along with a compliment of tables and projectors where screen 46 and whiteboards 48*a* and 48*b* are arranged so that perpendicular trajectories form the angles a1, a2 and a3 as described above with respect to FIG. 2. As still one other example, in at least some cases projectors 50*a*, 50*b* and 50*c* may be eliminated and interactive flat screen monitors (FSMS) may be provided instead of screen 46 and interactive boards 48*a* and 48*b*.

Figure 11:
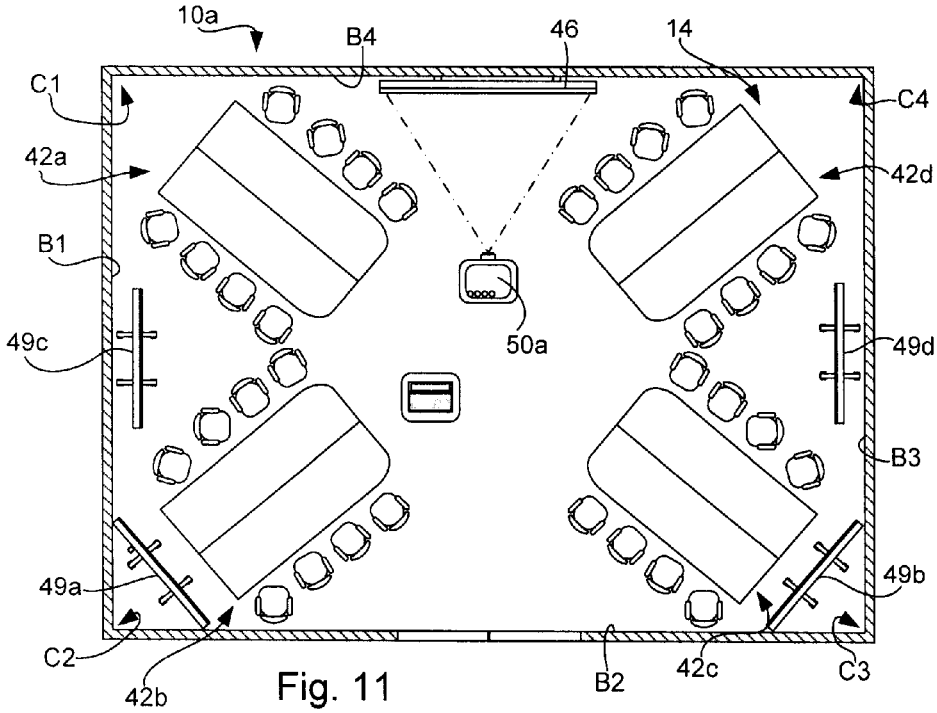
FIG. 11 is similar to FIG. 1, albeit where a different complement of presentation boards are included in the configuration.

Referring now to FIG. 11, a second exemplary furniture configuration 10*a* is illustrated that includes many of the components and assemblies described above with respect to FIG. 1. In FIG. 11, components that are similar to the components described above with respect to FIG. 1 are labeled with the numerals used above in FIG. 1 to indicate the similarity. Thus, configuration 10*a* includes first, second, third and fourth table assemblies 42*a*, 42*b*, 42*c* and 42*d* and a full complement of chairs 44 as well as projector 50*a* and projection screen 46. Here, the projection type interactive whiteboards 48*a* and 48*b* shown in FIG. 1 have been replaced by another type of display or presentation device, flat screen monitor type interactive whiteboards 49*a* and 49*b*. As the label implies, each of the flat screen monitor interactive whiteboards 49*a* and 49*b* includes a large flat panel display akin to a large computer monitor on which images can be generated by a flat screen monitor driver. As in the case of the projection type interactive whiteboards 48*a* and 48*b*, activities on the front surface of each of the whiteboards 49*a* and 49*b* are sensed and used to alter the images presented thereby or to control programs via onscreen icons in a manner well known in the art. Here, as in FIG. 1, although not separately illustrated, each of the interactive whiteboards 49*a* and 49*b*, in at least some embodiments, is supported on a cart that includes wheels so that the whiteboard can be moved around easily within space 14.

Referring still to FIG. 11, a second difference between assembly 10*a* and the assembly 10 described above with respect to FIG. 1 is that the whiteboard/camera assemblies 52*a* and 52*b* have been replaced by third and fourth flat screen monitor type interactive whiteboards 49*c* and 49*d* that include, like whiteboards 49*a* and 49*b*, large interactive flat screen monitors mounted on carts that include wheels so that the assemblies 49*c* and 49*d* can easily be moved around within space 14.

Figure 12:
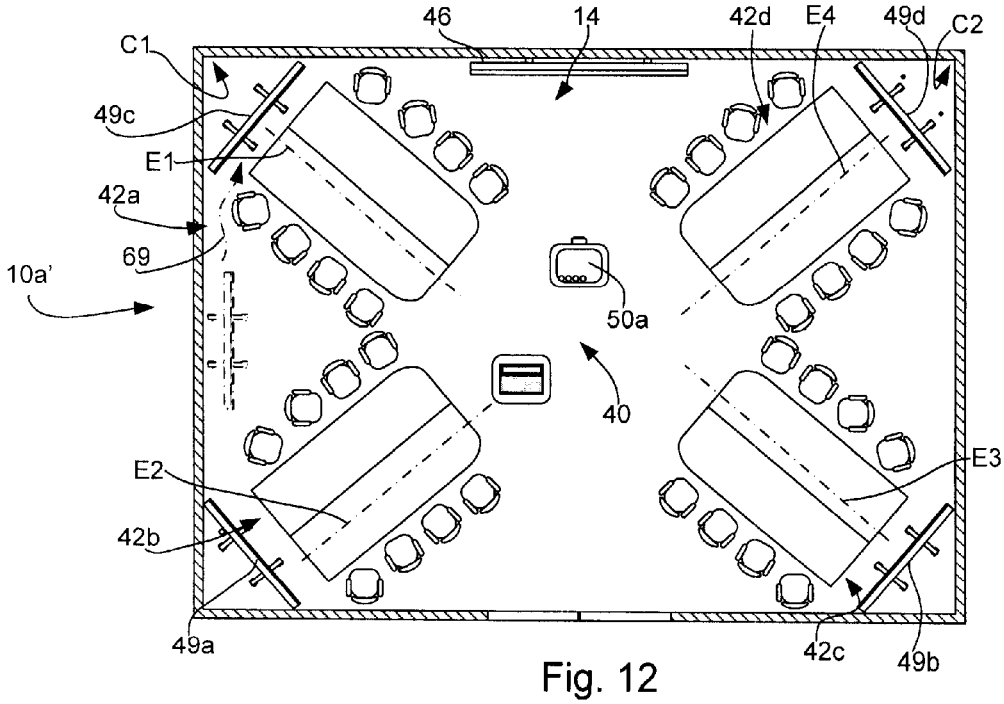
FIG. 12 is a similar to FIG. 11, albeit where two of the interactive whiteboards have been positioned on orientations suitable for small group activities.

A third difference between assembly 10*a* and FIG. 11 and assembly 10 described above with respect to FIG. 1 is that assembly 10*a* does not include whiteboard assemblies 54*a* and 54*b* and does not require the second and third projectors 50*b* and 50*c*. Here, projectors 50*b* and 50*c* are not required because each of the whiteboard assemblies 49*a* and 49*b* is a flat screen monitor capable of independently generating images. Whiteboard assemblies 54*a* and 54*b* are not needed in configuration 10*a* because interactive whiteboard assemblies 49*c* and 49*d* are mobile and therefore each can serve a dual purpose. To this end, whiteboard 49*c* can be used during large group discussions within space 14 by placing whiteboard 49*c* in the location shown in FIG. 11 adjacent first boundary B1 substantially midway corners C1 and C2. Then, when small group activities are to be performed, as shown in FIG. 12, whiteboard 49*c* can be moved as indicated by arrow 69*a* to a location proximate corner C1 and positioned in an angled orientation so that the front surface thereof generally faces central location 40 of space 14. Here, whiteboard 49*c* can be used by the small group located at table assembly 42*a* to facilitate small group activities.

Similarly, as shown in FIGS. 11 and 12, whiteboard 49*d* can be positioned in two different locations including the large group discussion location shown in FIG. 11 and the small group discussion location shown in FIG. 12 where the front surface of whiteboard 49*d* is angled to generally face central location 40 of space 14. In a small group location, whiteboard 49*d* is usable by the small group located at table assembly 42*d* to facilitate small group activities. During small group activities the elongation axis E1-E4 form angles with the front surfaces of whiteboards 49*c*, 49*a*, 49*b*, and 49*d* of between 75° and 90° and axis E1 and E3 form an angle between 0° and 20° while E2 and E4 form an angle between 0° and 20°.

Referring once again to FIG. 11, it should be appreciated that during large group discussions, a teacher or the like can use either of whiteboards 49*c* or 49*d* to capture group information in a digital format which can be presented in real time to classroom attendees via projector 50*a* and screen 46 and either of the whiteboards 49*a* and 49*b*. In addition, when the teacher is using one of whiteboards 49*c* or 49*d*, the information being presented via that whiteboard can simultaneously be presented via the other of the whiteboards 49*c* or 49*d*. In at least some cases, it is contemplated that, where a teacher prefers to use of the whiteboards 49*c* and 49*d* during large group activities, the other of the whiteboards 49*c* and 49*d* may be located in the small group location as shown in FIG. 12 so that the second whiteboard need not be moved when converting a configuration 10*a* between the large group discussion configuration and a small group activities configuration. Thus, for instance, during a large group discussion, whiteboard 49*c* may be positioned in the location shown in FIG. 11 while whiteboard 49*d* is positioned in a location shown in FIG. 12. Here, information presented via whiteboard 49*c* may be simultaneously presented via each of screen 46 and whiteboards 49*a* and 49*b* and also may be simultaneously presented via whiteboard 49*d* giving classroom attendees an additional common information display (e.g., 49*d*) to view during large group discussions.

Figure 13:
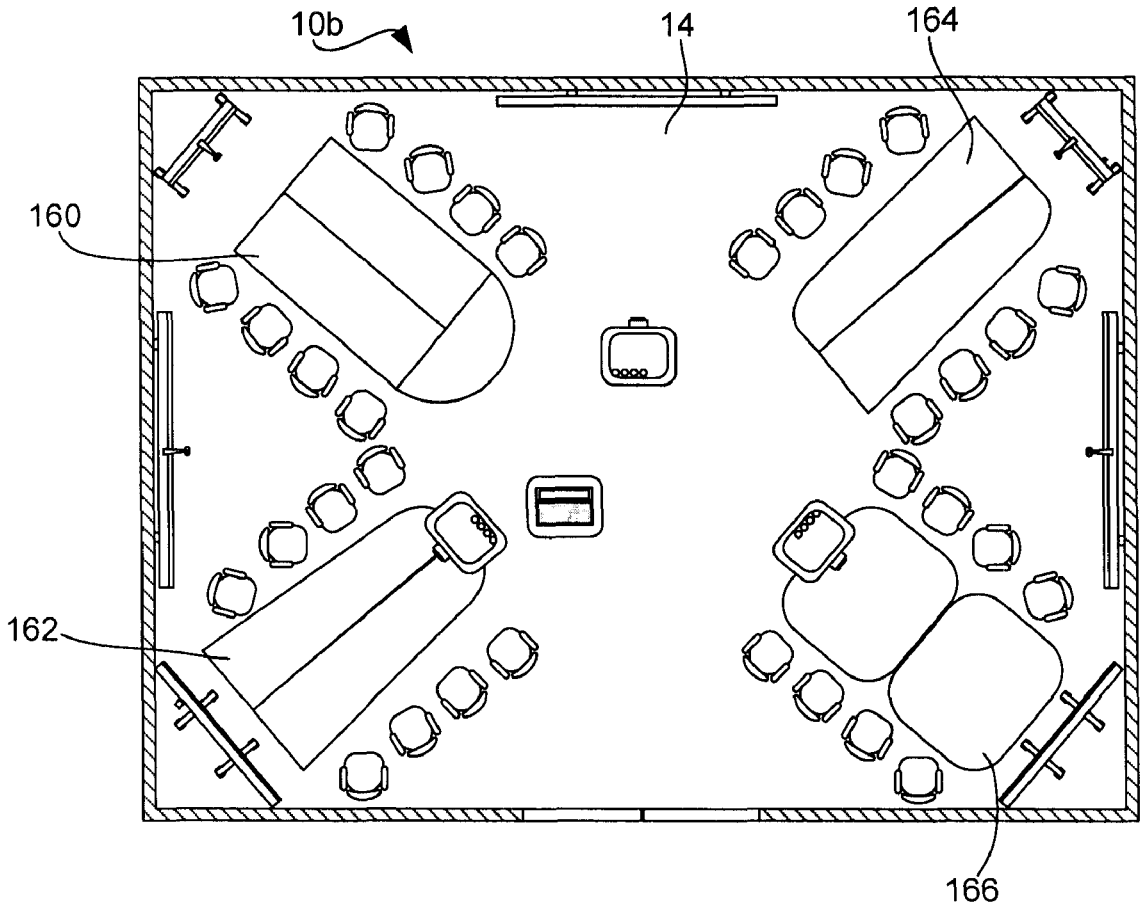
FIG. 13 is similar to FIG. 1, albeit illustrating several different types of table assemblies.

Referring again to FIG. 1, one type of table assembly 42*a* has been described above. Nevertheless, it should be appreciated that various types of table assemblies may be used in certain embodiments of the present invention. To this end, referring to FIG. 13, another furniture configuration 10*b* is illustrated that shows four different types of table assemblies 160, 162, 164 and 166 that have different table top configurations. Here, it should be appreciated that each of the table assemblies 160, 162, 166 and 164 has a generally rectangular overall top shape despite the fact that each of the table assemblies has a different configuration of top members. Thus, assembly 160 includes three tables where two of the tables are rectangular and the third table, an end table, is semicircular where, when the long edges of the rectangular tables abut and the semicircular table is placed at one end of the rectangular tables, the combined top members form an elongated rectangular shape. Table assembly 162 includes two tables where each of the tables includes a top member that has a shape similar to the shape of the tables 90 and 92 described above with respect to FIG. 1, albeit where the long edges of each of the top members diverge from one end to the other. Table assembly 164 includes first and second tables having top members that are identically shaped and each is identical to the shape of one of the top members included in subassembly 162, so that when the tables in assembly 164 are positioned with their long straight edges abutting, the combined shape thereof includes two generally right corners and two curved corners where every other corner is a curved corner. Table assembly 166 includes two generally square table top members where the corners of each one of the two table tops in assembly 166 have been generally rounded.

Referring once again to FIG. 1, while configuration 10 is shown as including three projectors 50*a*, 50*b*, and 50*c* and associated screen 46 and whiteboards 48*a* and 48*b*, it should be appreciated that, in at least some embodiments, more than three surfaces for simultaneous presentation of common information within a classroom space 14 are contemplated. To this end, referring to FIG. 14, a classroom configuration 10*c* is shown that includes four surfaces for presenting common information simultaneously. Configuration 10*c* includes several components that are similar to the components described above with respect to FIG. 1 and those components are labeled with numbers identical to the numbers used in FIG. 1. For instance, configuration 10*c* includes first, second, third and fourth table assemblies 42*a*, 42*b*, 42*c* and 42*d* and a full complement of chairs 44 as well as first, second and third projectors 50*a*, 50*b* and 50*c*. In addition to forming space 14, walls 16 and 20 extend past the fourth boundary B4 of space 14 to form a vestibule 170 adjacent space 14. An additional wall segment 172 is provided midway between the internal surfaces 30 and 34 of walls 16 and 20 along fourth boundary B4 to separate space 14 from vestibule 170.

Figure 14:
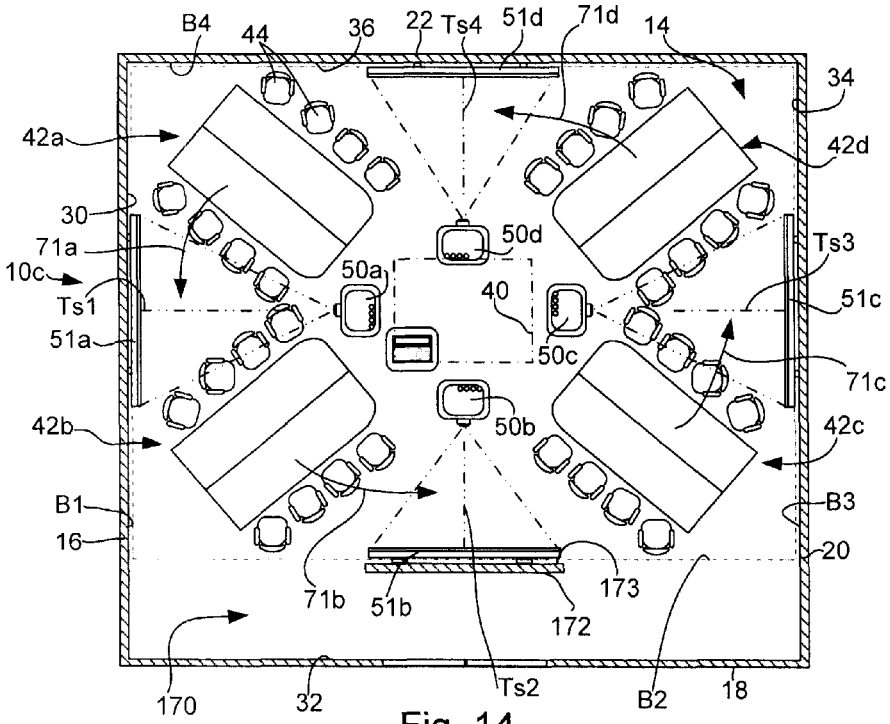
FIG. 14 is a top plan view of another classroom configuration that includes four wall mounted interactive whiteboards.

Referring still to FIG. 14, configuration 10*c* includes four separate projector type interactive whiteboards 51*a*, 51*b*, 51*c* and 51*d* as well as a fourth projector 50*d*. Each of the whiteboards 51*a* through 51*d* is similar to the projection type interactive whiteboards 48*a* and 48*b* described above with respect to FIG. 1 except that, instead of being mounted to a movable cart, each of whiteboards 51*a* through 51*d* is secured to a permanent wall surface. Thus, whiteboards 51*a* and 51*c* are secured opposite each other to internal surfaces 30 and 34 formed by wall members 16 and 20, respectively. Whiteboard 51*a* is secured to surface 30 about midway along first boundary B1 while whiteboard 51*c* is secured to surface 34 about midway along third boundary B3. Whiteboard 51*b* is secured to an internal surface 173 of additional wall 172 and whiteboard 51*d* is secured to internal surface 36 of wall 22 opposite whiteboard 51*b* and about midway along fourth boundary B4. When the whiteboards 51*a* through 51*d* are configured as described above, the front surfaces of each of those whiteboards generally faces central space location 40 and screen or display trajectories Ts1, Ts2, Ts3 and Ts4 that are perpendicular to whiteboard surfaces extend toward central location 40. In particularly advantageous embodiments trajectories Ts1 and Ts2 form an angle between 75° and 105°, trajectories Ts2 and Ts3 form an angle between 75° and 105°, trajectories Ts3 and Ts4 form an angle between 75° and 105° and trajectories Ts1 and Ts4 form an angle between 75° and 105°. Projectors 50*a*, 50*b*, 50*c* and 50*d* are mounted to a ceiling structure above space 14 (not illustrated in FIG. 14) and are oriented so that they project images on front surfaces of whiteboards 51*a*, 51*b*, 51*c* and 51*d*.

Referring yet again to FIG. 14, during a large group discussion, table assemblies 42*a* through 42*d* are arranged so that the table length dimensions thereof extend along trajectories from the four corners of space 14 toward central location 40 in a manner similar to that described above with respect to FIG. 1. Here, an instructor or any classroom attendee can present information via all of the whiteboards 51*a* through 51*d* simultaneously and any instructor or attendee in classroom 14 can use any of the whiteboards to edit an image, create a new image or control application programs as known in the art. Here, when an image is edited or an application is controlled via one of the whiteboards 51*a* through 51*d*, the information presented via that whiteboard is simultaneously updated and presented via the other three whiteboards shown in FIG. 14.

Figure 15:
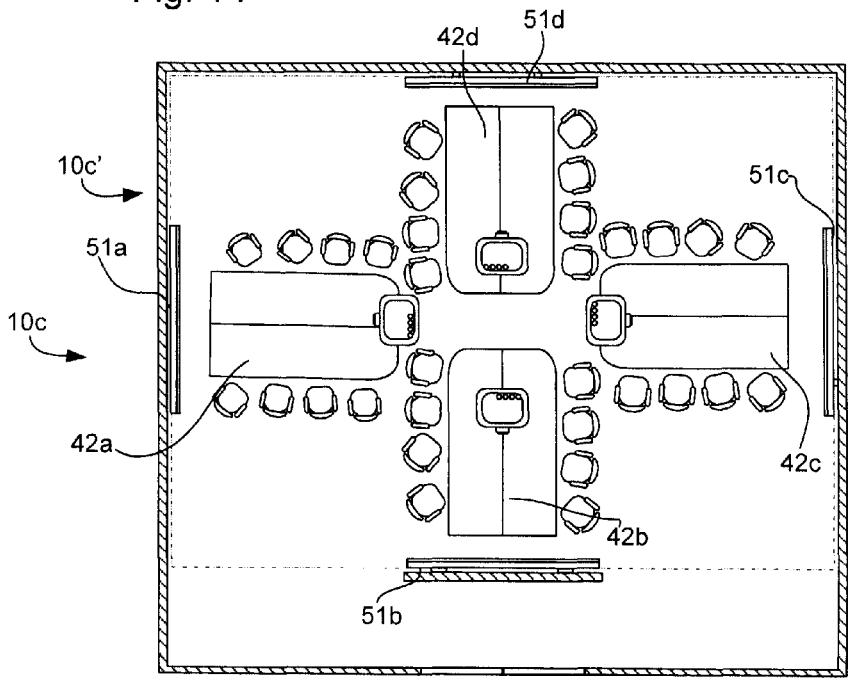
FIG. 15 is similar to FIG. 14, albeit where table assemblies and chairs have been moved into a different orientation for small group activities.

Referring again to FIG. 14 and also FIG. 15, when small group activities are to be performed, the table assemblies 42*a* through 42*d* can be rotated within space 14 as indicated by arrows 71*a*, 71*b*, 71*c* and 71*d* so that ends of the assemblies 42*a* through 42*d* are adjacent to front surfaces of whiteboards 51*a* through 51*d* as shown in the FIG. 15 configuration 10*c*'. Here, small groups at assemblies 42*a*, 42*b*, 42*c* and 42*d* can use whiteboards 51*a*, 51*b*, 51*c* and 51*d* to facilitate small group activities.

Figure 16:
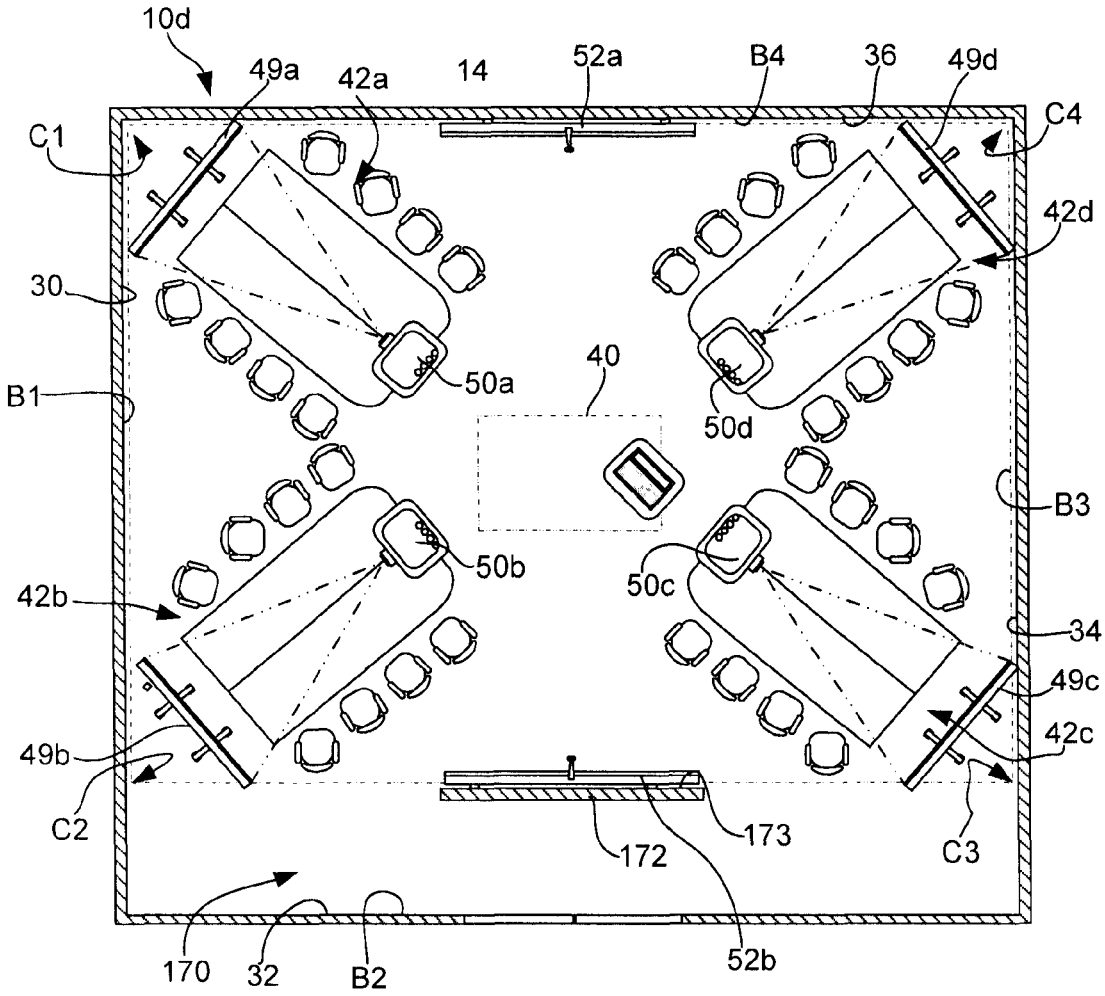
FIG. 16 a top plan view of yet another classroom configuration including four interactive whiteboards and two whiteboard/camera assemblies.

Referring now to FIG. 16, an additional classroom configuration 10*d* is illustrated. Here, configuration 10*d* is shown in a conference space 14 formed by walls that include an entry vestibule 170 as described above with respect to FIG. 14. Configuration 10*d* includes several components and assemblies that are similar to those described above and those components and assemblies are labeled with the same numbers used above. Thus, configuration 10*d* includes first, second, third and fourth table assemblies 42*a*, 42*b*, 42*c* and 42*d*, respectively, first, second, third and fourth projection type interactive whiteboards, 48*a*, 48*b*, 48*c* and 48*d*, respectively, first through fourth projectors 50*a* through 50*d* and first and second whiteboard/camera assemblies 52*a* and 52*b*. As in FIG. 1, assemblies 42*a* through 42*d* are arranged so that table length dimensions are aligned along trajectories that extend from corners C1 through C4 toward central location 40. Whiteboards 48*a*, 48*b*, 48*c* and 48*d* are positioned adjacent corners C1, C2, C3 and C4, respectively, and are angled so that front surfaces thereof generally face central location 40.

Whiteboard/camera assembly 52*a* is mounted along fourth boundary B4 substantially midway between corners C1 and C4 so that a front surface thereof faces central location 40. Similarly, whiteboard/camera assembly 52*b* is mounted to internal surface 173 of wall 172 along boundary B2 so that a front surface thereof generally faces central location 40 and opposes the front surface of whiteboard 53*a*. Here, during large group discussions, an instructor or any attendee within space 14 can create an image using either of whiteboards 52*a* and 52*b* and can visually capture that image via one of the cameras associated with one of those whiteboards. In addition, during large group discussions, common information can be projected simultaneously on the front surfaces of each of whiteboards 48*a*, 48*b*, 48*c* and 48*d* so that attendees within space 14 can view the common information in any of four different locations.

Figure 17:
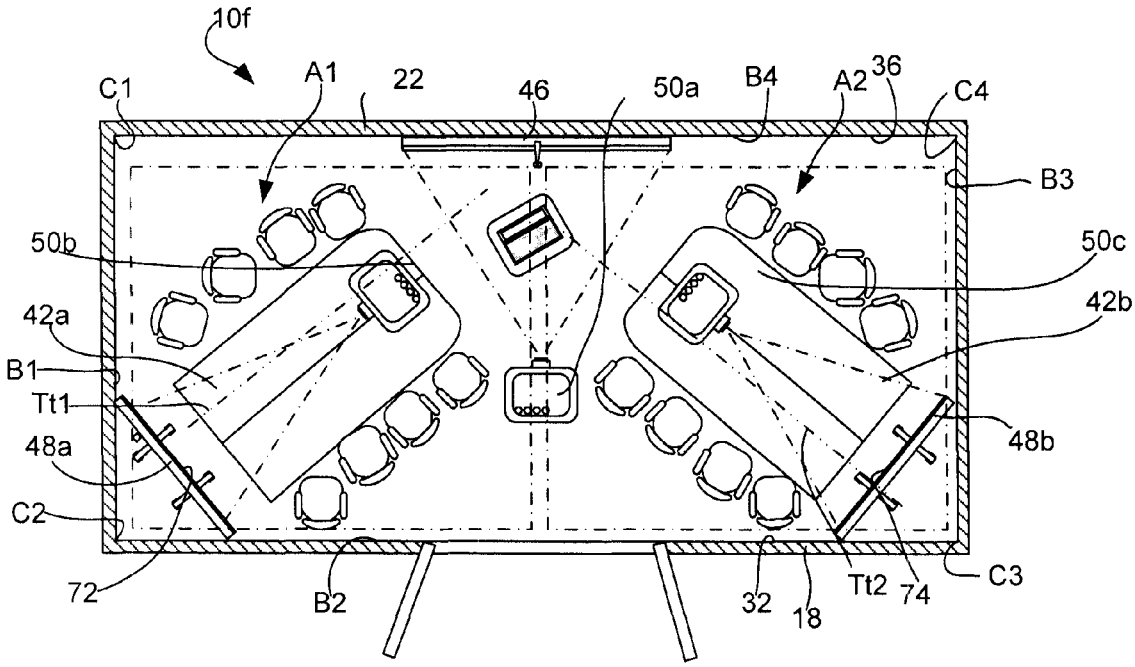
FIG. 17 is a top plan view of yet another exemplary classroom configuration that is consistent with at least some aspects of the present invention.

Referring now to FIG. 17, a two table classroom configuration 10*f* is illustrated that has several components and assemblies in common with the configurations described above. Here, instead of the classroom space including four corner areas, the space includes two similarly shaped and sized rectangular lateral areas A1 and A2 that are adjacent first and third boundaries B1 and B3. This configuration includes whiteboard/camera assembly 52, first and second projection type interactive whiteboards 48*a* and 48*b* and first, second and third projectors 50*a*, 50*b* and 50*c*, respectively. Whiteboard 52 is mounted midway along wall surface 36 and faces second boundary B2. Whiteboards 48*a* and 48*b* are located at corners C2 and C3 and are angled so that screen trajectories Ts2 and Ts3 form substantially 120 degree angles with a first screen trajectory Ts1. During large group activities an instructor can use whiteboard 52 to lecture or develop large group materials. Information can be simultaneously presented via whiteboards 52, 48 and 48*b*. During small group activities groups at table assemblies 42*a* and 42*b* can use boards 48*a* and 46*b*.

Figure 18:
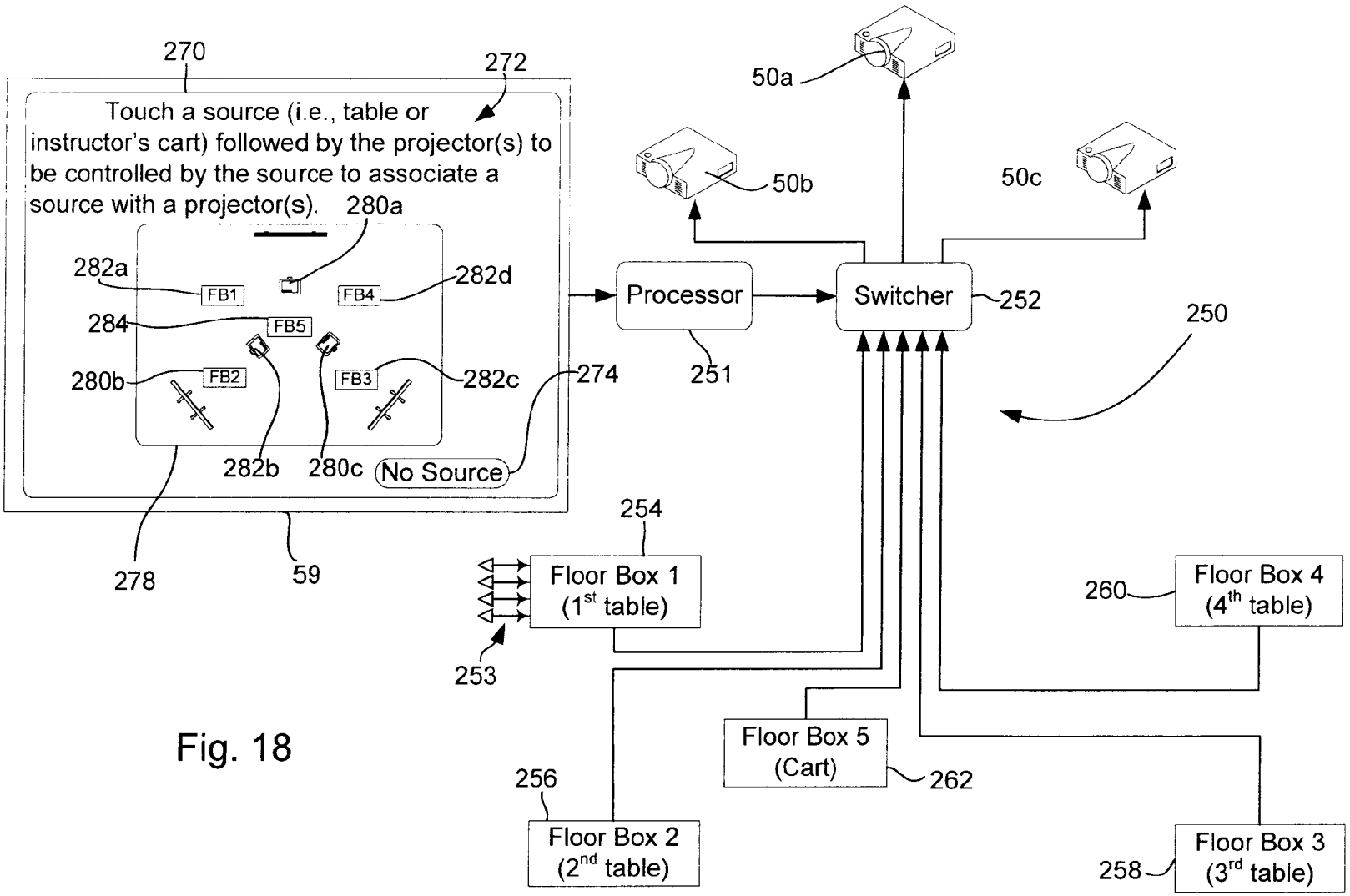
FIG. 18 is a schematic of a projector control system consistent with at least some aspects of the present invention.

Referring now to FIG. 18, an exemplary projector/source control system 250 that is consistent with at least some aspects of the present invention is illustrated. System 250 includes first through fifth floor boxes 254, 256, 258, 260 and 262, respectively, a switch/router 252 and an interface device such as laptop 59 described above. As the label implies, floor boxes 254, 256, 258, 260 and 262 are boxes mounted within the floor structure below classroom space 14 (see again FIG. 1) and include power, data and video linking receptacles/ports (see exemplary ports 253 in FIG. 19) for laptops or other types of computers. In the present example, floor box 254 would be located below or proximate the location occupied by table assembly 42*a* shown in FIG. 1. Similarly, boxes 256, 258 and 260 would be located below or proximate the locations of tables 42*b*, 42*c* and 42*c*, respectively, in FIG. 1. Box 262 would be located generally near or at the central location 40 in FIG. 1. Thus, boxes 254, 256, 258, 260 and 262 are positioned at locations that are convenient for linking to laptops or interface devices at table assemblies 42*a*, 42*b*, 42*c* and 42*d* or cart 60 (see FIG. 1).

Referring still to FIG. 18, each of the video ports from boxes 253 through 262 is linked to switcher 252. Switcher 252 has three outputs, a separate output linked to each of the projectors 50*a*, 50*b* and 50*c*. Here switcher 252 is capable of linking the boxes 254 through 262 to projectors 50*a*, 50*b*, and 50*c* in different ways. For instance, in at least some applications switcher 252 can link any of the boxes 254 through 262 to anyone of the projectors 50*a*, 50*b*, or 50*c* or to any subset of the projectors. Thus, for instance, box 254 may be linked to projector 50*a* or to the subset of projectors including projectors 50*b* and 50*c* or to all projectors 50*a*, 50*b* and 50*c*.

In additions, switcher 252 may be controlled to simultaneously link different floor boxes to different projectors or subsets of projectors. For instance, box 254 may be linked to projectors 50*a* and 50*b* while box 258 is linked to projector 50*c* or boxes 254, 256 and 258 may be linked to projectors 50*a*, 50*b* and 50*c*, respectively. When a floor box is linked to one or more projectors, a laptop or the like linked to the floor box controls the information presented via the linked projector(s).

Referring still to FIG. 18, interface device 59 includes a processor 251 and an interface screen 170. Processor 251 runs software programs to control switcher 252 and to receive input via screen 270. In at least some embodiments screen 270 is touch sensitive so that an instructor can select on-screen icons to associate boxes/sources with projectors. In other cases sources and projectors can be selected via a mouse controlled pointing cursor as well known it the art.

Exemplary screen 270 includes instructions 272 and a top plan schematic 278 illustrating the layout of boxes and projections in the associated classroom space 14 (see again FIG. 1). Consistent with FIG. 1, schematic 278 includes screen selectable icons 280*a*, 280*b* and 280*c* corresponding to projectors 50*a*, 50*b* and 50*c* where the selectable icons are arranged in the same relative juxtaposed that the associated projectors 50*a*, 50*b* and 50 are arranged in. In addition, screen 270 includes selectable floor box icons 282*a* through 282*e* corresponding to floor boxes 254 through 262 where icons 282*a* through 282*e* are arranged in the same pattern as the floor boxes in space 14.

Here, as indicated by instructions 272, to associate a box 254 through 262 with a projector, in at least some embodiments, an instructor simply selects a box icon on screen 270 followed by a projector icon. For instance, in FIG. 19, to associate box 254 with projector 50*b*, the instructor selects box icon 282*a* followed by projector icon 280*b*. Similarly, to associate box 254 with all projectors 50*a* through 50*c*, the instructor selects box icon 280*a* followed by each of projector icons 50*a* through 50*c*. Once one or more projectors are associated with source boxes, the association can be altered by simply reselecting via screen 270. To blank projected images, a "No Source" icon 274 may be selected followed by projector icons associated with projectors to be blanked.

One or more specific embodiments of the present invention have been described above. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Thus, the invention is to cover all modifications, equivalents, and alternatives falling within the spirit and scope of the invention as defined by the following appended claims. For example, while a space 14 is described above as including five floor boxes, in other embodiments other numbers of floor boxes may be includes (i.e., there may be eight floor boxes substantially equispaced within space 14.

Figure 19:
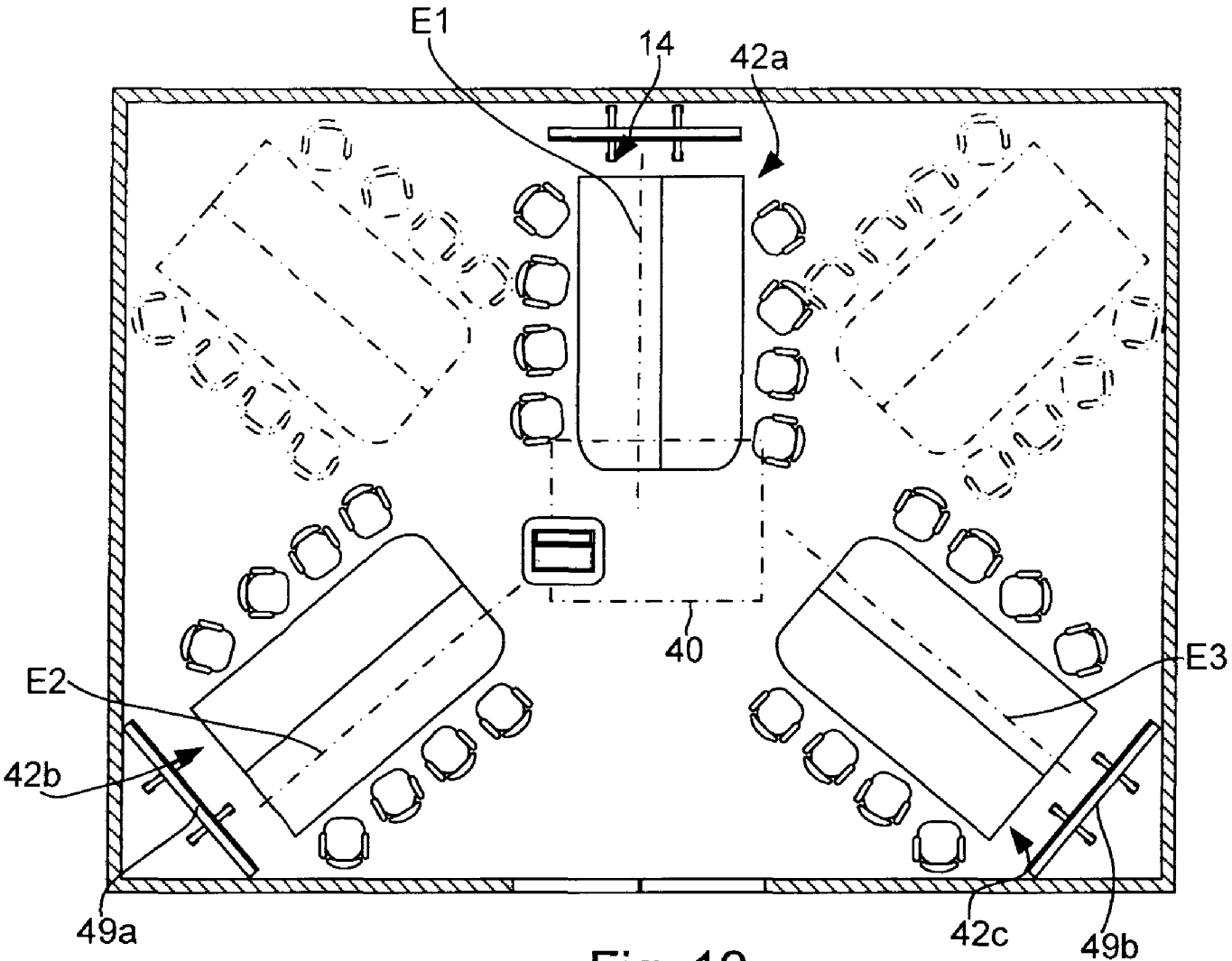
FIG. 19 is a schematic of yet another inventive classroom or learning environment consistent with at least some aspects of the present invention.

As another example, while each table assembly 42*a*-42*d*, etc. has been described above as including two table tops, other embodiments may include single table top assemblies. Moreover, embodiments with three table assemblies are contemplated as shown in FIG. 19 where each table assembly 42*a*, 42*b* and 42*c* is independently aligned with separate electronic display devices 49*a*-49*c*. As above, the elongation axis E1-E3 form angles between 75° and 90° with the front surfaces of adjacent display devices and display trajectories that are perpendicular to the front flat surfaces of the displays form angles within a range between 100° and 130°. In addition, as implied in FIG. 19 by two additional phantom tables, embodiments that include five or more table are also contemplated where the tables are arranged in a radial pattern about a central area.

As still one other example, while space 14 is described above as being defined by walls, it should be appreciated that any space of suitable size, regardless of the surrounding wall structure, may serve as a learning environment.

To apprise the public of the scope of this invention, the following claims are made:

What is claimed is:

1. A learning environment having a plurality of tables and a plurality of technology display devices distributed about the environment for use by occupants of the learning environment, the environment including a central area, the learning environment comprising:

a) at least first, second and third technology display devices that include first, second and third substantially flat display surfaces, respectively, for displaying information to occupants in the environment, the first, second and third displays supported in spaced radial relationship about the environment with the flat display surfaces substantially facing the central area; and b) at least first, second and third elongated tables that have first, second and third elongation axis, respectively, the tables arranged in spaced radial orientations around the environment with the elongation axis substantially extending toward the central area and so that open spaces are formed between adjacent tables for standing occupants, wherein the second and third elongation axis form angles with the second and third display surfaces in the range between seventy-five and ninety degrees.

2. The environment of claim 1 wherein the first elongated axis forms an angle with the first display surface that is in the range of between seventy-five and ninety degrees.

3. The environment of claim 2 wherein the angles between the first, second and third elongation axis and the first, second and third display surfaces are approximately ninety degrees.

4. The environment of claim 1 wherein first, second and third display trajectories are perpendicular to the first, second and third display surfaces, respectively, and wherein the first, second and third displays are supported at the corners of a triangle within the environment so that the first and second display trajectories form an angle between the range of 100 and 130 degrees, the second and third display trajectories form an angle between the range of 100 and 130 degrees and wherein the third and first display trajectories form an angle between the range of 100 and 130 degrees.

5. The environment of claim 1 wherein each of the angles between the first and second display trajectories, the second and third display trajectories and the third and first display trajectories is substantially 120 degrees.

6. The environment of claim 4 wherein the first table is positioned with the first elongation axis forming an angle between zero degrees and 20 degrees with the third elongation axis, the environment further including a fourth table having a fourth elongation axis, the fourth table positioned so that the fourth elongation axis forms an angle between zero degrees and 20 degrees with the second elongation axis.

7. The environment of claim 6 wherein the first and third elongation axis are substantially parallel and wherein the second and fourth elongation axis are substantially parallel.

8. The environment of claim 7 wherein the first elongation axis forms an angle with the second elongation axis in the range between seventy-five and ninety degrees.

9. The environment of claim 6 further including a switcher and first, second, third and fourth floor boxes, each floor box including a video port for linking to a source device, each video port linked to the switcher, the switcher including separate outputs for each of the display devices for selectively linking the video ports to the display devices, the first, second, third and fourth floor boxes located within the environment proximate the first, second, third and fourth tables for linking source devices at the first, second, third and fourth tables to the first, second and third display devices.

10. The environment of claim 1 further including a fourth technology display device supported in spaced radial relationship about the environment and with respect to the first through third display devices, the fourth display device having a fourth substantially flat display surface that substantially faces the central area.

11. The environment of claim 10 wherein the first and third display surfaces substantially face each other and wherein the second and fourth display surfaces substantially face each other.

12. The environment of claim 10 wherein first, second, third and fourth display trajectories are perpendicular to the first, second, third and fourth display surfaces, respectively, and wherein the first and second display trajectories form an angle between the range of 75 and 105 degrees, the second and third display trajectories form an angle between the range of 75 and 105 degrees, the third and fourth display trajectories form an angle between the range of 75 and 105 degrees and the fourth and first display trajectories form an angle within the range between 75 and 105 degrees.

13. The environment of claim 12 further including a fourth table having a fourth elongation axis, wherein the first and fourth elongation axis form angles with the first and fourth display surfaces in the range between seventy-five and ninety degrees.

14. The environment of claim 13 wherein the wherein the first, second, third and fourth elongation axis form substantially ninety degree angles with the first, second, third and fourth display surfaces, respectively.

15. The environment of claim 1 wherein the environment resides within a rectangular space having first, second, third and fourth corners and first, second, third and fourth boundaries between the first and second corners, the second and third corners, the third and fourth corners and the fourth and first corners, respectively, the second and third display devices supported at the second and third corners, respectively.

16. The environment of claim 15 wherein the first display device is supported substantially midway along the fourth boundary.

17. The environment of claim 16 further including first and second whiteboards supported substantially midway along the first and third boundaries, respectively.

18. The environment of claim 17 wherein each of the first and second whiteboards includes a substantially flat whiteboard surface that has height and width dimensions of at least four feet and at least five feet, respectively.

19. The environment of claim 17 further including first and second cameras supported adjacent the first and second whiteboard surfaces for capturing images of information applied to the whiteboard surfaces.

20. The environment of claim 15 wherein the first, second, third and fourth boundaries have first, second, third and fourth boundary length dimensions that are less than forty-five feet, respectively.

21. The environment of claim 20 wherein the first, second, third and fourth boundary length dimensions are less than 35 feet.

22. The environment of claim 21 wherein each of the display surfaces has height and width dimensions of at least three feet and at least four feet, respectively.

23. The environment of claim 21 wherein each of the display surfaces has height and width dimensions of substantially four feet and substantially five feet, respectively.

24. The environment of claim 21 wherein the first, second and third tables have first, second and third table length dimensions and wherein each of the table length dimensions is at least six feet.

25. The environment of claim 24 wherein each of the table length dimensions is substantially eight feet.

26. The environment of claim 1 wherein the first, second and third display devices include first, second and third projectors that project images onto the first, second and third display surfaces, respectively.

27. The environment of claim 26 wherein at least one of the display devices further includes an interactive whiteboard that forms the display surface.

28. The environment of claim 27 wherein the second and third display devices includes first and second interactive whiteboards, respectively.

29. A learning environment located within a space wherein the space has first, second, third and fourth corners and first, second, third and fourth boundaries between the first and second corners, the second and third corners, the third and fourth corners and the fourth and first corners, respectively, the space including first and second substantially equally sized lateral rectangular space areas adjacent the first and third boundaries, respectively, and also including a central area, the environment comprising:

first and second elongated tables that have first and second table length dimensions, respectively; and first, second and third image presentation devices that include substantially flat first, second and third presentation surfaces, respectively;

the first and second tables positioned in the first and second lateral areas so that the first and second table length dimensions are aligned with first and second table trajectories that form angels with adjacent boundaries that are within a range of between 30 degrees and 60 degrees;

the first presentation device is supported along the first boundary substantially midway between the first and fourth corners with the first presentation surface generally facing the central area;

the second presentation device is supported proximate the second corner with the second presentation surface forming an angle between 75 and 90 degrees with the first table trajectory; and the third presentation device is supported proximate the third corner with the third presentation surface forming an angle between 75 and 90 degrees with the second table trajectory.

30. The environment of claim 29 wherein the first lateral area include first and second corner areas adjacent the first and second corners, respectively, the second lateral area include third and fourth corner areas adjacent the third and fourth corners, respectively, the first and second tables are positioned within the second and third corner areas, respectively, the environment further including at least a third table that includes a third table length dimension wherein the third table is positioned in at least one of the first and fourth corner areas and so that the third table length dimension is aligned with a third table trajectory.

31. The environment of claim 30 wherein each of the boundaries is less than 45 feet.

32. The environment of claim 30 wherein each of the boundaries is less than 35 feet.

33. The environment of claim 32 wherein each of the first and fourth boundaries has a similar length dimension and wherein the first boundary is substantially 30 feet.

34. The environment of claim 32 wherein the presentation devices have height and width dimensions of at least three feet and four feet, respectively.

35. The environment of claim 32 wherein the presentation devices have height and width dimensions of substantially four feet and substantially five feet, respectively.

36. The environment of claim 30 wherein the tables have table length dimensions that are substantially eight feet.

37. The environment of claim 30 wherein the third table is positioned within the first corner area, the environment further including a fourth elongated table that has a fourth table length dimension and that is positioned in the fourth corner area.

38. The environment of claim 37 wherein the first, second, third and fourth table trajectories form angels with adjacent boundaries that are substantially 45 degrees.

39. The environment of claim 30 wherein the second presentation surface forms angles with each of the first and second boundaries that are between 30 and 60 degrees and wherein the third presentation surface forms angles with each of the second and third boundaries that are between 30 and 60 degrees.

40. The environment of claim 39 wherein the angles formed between the second presentation surface and the first and second boundaries and the angles formed between the third presentation surface and the second and third boundaries are substantially 45 degrees.

41. The environment of claim 30 wherein the first, second and third presentation devices include first, second and third projectors that project images onto the first, second and third presentation surfaces, respectively.

42. The environment of claim 40 wherein the second and third presentation devices include first and second interactive whiteboards where the first and second whiteboards form the second and third presentation surfaces, respectively.

43. A method for arranging a learning environment having a plurality of tables and a plurality of technology display devices distributed about the environment for use by occupants of the learning environment, the environment including a central area, the method comprising the steps of:

providing at least first, second and third technology display devices that include first, second and third substantially flat display surfaces, respectively, for displaying information to occupants in the environment;

providing at least first, second and third elongated tables that have first, second and third elongation axis, respectively;

positioning the first, second and third displays in spaced radial relationship about the environment with the flat display surfaces substantially facing the central area; and positioning the tables in spaced radial orientations around the environment with the first, second and third elongation axis substantially extending toward the central area and so that open spaces are formed between adjacent tables for standing occupants, wherein the second and third elongation axis form angles with the second and third display surfaces in the range between seventy-five and ninety degrees, respectively.

44. The method of claim 43 wherein the first elongated axis forms an angle with the first display surface that is in the range of between seventy-five and ninety degrees.

45. The method of claim 44 wherein the angles between the first, second and third elongation axis and the first, second and third display surfaces are approximately 90 degrees.

46. The method of claim 43 wherein first, second and third display trajectories are perpendicular to the first, second and third display surfaces, respectively, and wherein the steps of positioning the display devices includes the step of supporting the first, second and third display devices at the corners of a triangle within the environment so that the first and second display trajectories form an angle between the range of 100 and 130 degrees, the second and third display trajectories form an angle between the range of 100 and 130 degrees and wherein the third and first display trajectories form an angle between the range of 100 and 130 degrees.

47. The method of claim 43 wherein each of the angles between the first and second display trajectories, the second and third display trajectories and the third and first display trajectories is substantially 120 degrees.

48. The method of claim 47 wherein the step of positioning the first table includes positioning the first table so that the first elongation axis forms an angle between zero degrees and 20 degrees with the third elongation axis, the method including the steps of providing a fourth table having a fourth elongation axis and positioning the fourth table so that the fourth elongation axis forms an angle between zero degrees and 20 degrees with the second elongation axis.

49. The method of claim 48 wherein the first and third elongation axis are substantially parallel and wherein the second and fourth elongation axis are substantially parallel.

50. The method of claim 49 wherein the first elongation axis forms an angle with the second elongation axis in the range between seventy-five and ninety degrees.

51. The method of claim 48 further including the steps of providing a switcher and first, second, third and fourth floor boxes, each floor box including a video port for linking to a source device, positioning the first, second, third and fourth floor boxes within the environment proximate the first, second, third and fourth tables, respectively, linking each video port to the switcher, the switcher including separate outputs for each of the display devices for selectively linking the video ports to the display devices.

52. The method of claim 43 further including the steps of providing a fourth technology display device that includes a fourth substantially flat display surface and positioning the fourth display device in spaced radial relationship about the environment and with respect to the first through third display devices so that the fourth display surface substantially faces the central area.

53. The method of claim 52 wherein the steps of positioning first and third display devices and positioning the second and fourth display devices include positioning the first and third display devices so that the first and third display surfaces substantially face each other and positioning the second and fourth display devices so that the second and fourth display surface substantially face each other.

54. The method of claim 53 wherein the step of positioning the first table includes positioning the first table so that the first elongation axis forms an angle with the first display surface in the range between seventy-five and ninety degrees, the method further including the steps of providing a fourth table having a fourth elongation axis and positioning the fourth table so that the fourth elongation axis forms an angle with the fourth display surface in the range between seventy-five and ninety degrees.

55. The method of claim 54 wherein the wherein the first, second, third and fourth elongation axis form substantially ninety degree angles with the first, second, third and fourth display surfaces, respectively.

56. The method of claim 43 wherein the environment resides within a rectangular space having first, second, third and fourth corners and first, second, third and fourth boundaries between the first and second corners, the second and third corners, the third and fourth corners and the fourth and first corners, respectively, the steps of positioning the second and third display devices including positioning the second and third display devices at the second and third corners, respectively.

57. The method of claim 56 wherein the step of positioning the first display devices includes positioning the first display device substantially midway along the fourth boundary.

58. The method of claim 57 further including the steps of providing first and second whiteboards and supporting the first and second whiteboards substantially midway along the first and third boundaries, respectively.

59. The method of claim 56 wherein the first, second, third and fourth boundaries have first, second, third and fourth boundary length dimensions that are less than forty-five feet, respectively.

60. The method of claim 59 wherein the first, second, third and fourth boundary length dimensions are less than 35 feet.

61. The method of claim 60 wherein each of the display surfaces has height and width dimensions of at least three feet and at least four feet, respectively.

62. The method of claim 60 wherein the first, second and third tables have first, second and third table length dimensions and wherein each of the table length dimensions is at least six feet.

63. The method of claim 43 wherein the step of providing display devices includes the step of providing first, second and third projectors that project images onto the first, second and third display surfaces, respectively.

64. The method of claim 28 wherein the step of providing the second and third display devices includes the step of providing first and second interactive whiteboards, respectively.

65. A method for arranging a learning environment having a plurality of tables and a plurality of technology display devices distributed about the environment for use by occupants of the learning environment, the environment including a space wherein the space has first, second, third and fourth corners and first, second, third and fourth boundaries between the first and second corners, the second and third corners, the third and fourth corners and the fourth and first corners, respectively, the space including first and second substantially equally sized rectangular space lateral areas adjacent the first and third boundaries, respectively, and also including a central area, the method comprising the steps of:

providing first and second elongated tables that have first and second table length dimensions, respectively;

providing first, second and third image presentation devices that include substantially flat first, second and third presentation surfaces, respectively;

positioning the first and second tables in the second and third corner areas so that the first and second table length dimensions are aligned with first and second table trajectories that form angels with adjacent boundaries that are within a range of between 30 degrees and 60 degrees;

positioning the first presentation device along the first boundary substantially midway between the first and fourth corners with the first presentation surface generally facing the central area;

positioning the second presentation device proximate the second corner with the second presentation surface forming an angle with the first table trajectory of between 75 and 90 degrees; and positioning the third presentation device proximate the third corner with the third presentation surface forming an angle with the second table trajectory of between 75 and 90 degrees.

66. The method of claim 65 wherein the first lateral area include first and second corner areas adjacent the first and second corners, respectively, the second lateral area include third and fourth corner areas adjacent the third and fourth corners, respectively, the step of positioning the first and second tables including positioning the first and second tables within the second and third corner areas, respectively, the environment further including at least a third table that includes a third table length dimension wherein the third table is positioned in at least one of the first and fourth corner areas and so that the third table length dimension is aligned with a third table trajectory.

67. The method of claim 66 wherein each of the boundaries is less than 45 feet.

68. The method of claim 66 wherein each of the boundaries is less than 35 feet.

69. The method of claim 68 wherein each of the first and fourth boundaries has a similar length dimension and wherein the first boundary is substantially 30 feet.

70. The method of claim 66 wherein the step of providing presentation devices includes providing presentation devices that have height and width dimensions of at least three feet and four feet, respectively.

71. The method of claim 66 wherein the step of providing presentation devices includes providing presentation devices that have height and width dimensions of substantially four feet and substantially five feet, respectively.

72. The method of claim 66 wherein the step of providing tables includes providing tables that have table length dimensions that are substantially eight feet.

73. The method of claim 66 wherein the step of positioning the first table includes positioning the first table within the first corner area, the method further including the steps of providing a fourth elongated table that has a fourth table length dimension and positioning the fourth table in the fourth corner area.

74. The method of claim 73 wherein the step of positioning the tables includes positioning the tables so that the first, second, third and fourth table trajectories form angels with adjacent boundaries that are substantially 45 degrees.

75. The method of claim 66 wherein the step of positioning the second presentation device includes positioning the second presentation device so that the second presentation surface forms angles with each of the first and second boundaries that are between 30 and 60 degrees and wherein the step of positioning the third presentation device includes positioning the third presentation device so that third presentation surface forms angles with each of the second and third boundaries that are between 30 and 60 degrees.

76. The method of claim 75 wherein the angles formed between the second presentation surface and the first and second boundaries and the angles formed between the third presentation surface and the second and third boundaries are substantially 45 degrees.

77. The method of claim 66 wherein the step of providing presentation devices includes providing first, second and third projectors that project images onto the first, second and third presentation surfaces, respectively.

78. The method of claim 77 wherein the step of providing second and third presentation devices further includes providing first and second interactive whiteboards where the first and second whiteboards form the second and third presentation surfaces, respectively.

79. A learning environment having a plurality of tables and a plurality of technology display devices distributed about the environment for use by occupants of the learning environment, the environment including a central area, the learning environment comprising:

first, second and third technology display devices that include first, second and third substantially flat display surfaces, respectively, for displaying information to occupants in the environment, first, second and third display trajectories substantially p[perpendicular to the first, second and third display surfaces, respectively, the first, second and third displays supported at the corners of a triangle in spaced radial relationship about the environment with the flat display surfaces substantially facing the central area so that the first and second display trajectories, the second and third display trajectories and the third and first display trajectories form angles within a range between 100 and 140 degrees; and first, second, third and fourth elongated tables that have first, second, third and fourth elongation axis, respectively, the tables arranged in spaced radial orientations around the environment with the elongation axis substantially extending toward the central area and so that open spaces are formed between adjacent tables for standing occupants, wherein the second and third elongation axis form angles with the second and third display surfaces in a range between seventy-five and ninety degrees.

* * * * *